US006240841B1

(12) United States Patent
Newman et al.

(10) Patent No.: US 6,240,841 B1
(45) **Date of Patent: *Jun. 5, 2001**

(54) RETRACTABLE PALLET ATTACHMENT FOR SCREEN PRINTING

(75) Inventors: Don Newman, Wyncote, PA (US); Thomas A. McKeever, Maple Shade, NJ (US)

(73) Assignee: Stretch Devices, Inc., Philadelphia, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/024,338

(22) Filed: Feb. 17, 1998

Related U.S. Application Data

(63) Continuation-in-part of application No. 08/649,597, filed on Jul. 3, 1996, now abandoned, which is a continuation-in-part of application No. 08/329,022, filed on Oct. 25, 1994, now Pat. No. 5,503,068.

(51) Int. Cl.[7] ..... B41F 15/16

(52) U.S. Cl. ..... 101/126; 101/127.1; 101/DIG. 36

(58) Field of Search ..... 101/115, 126, 101/127.1, 128, 128.1, DIG. 36, 129, 485, 486

(56) References Cited

U.S. PATENT DOCUMENTS

| | | | |
|---|---|---|---|
| 3,492,900 | 2/1970 | Hill et al. | 83/464 |
| 4,901,638 | 2/1990 | Jennings | 101/126 |
| 4,911,070 | 3/1990 | Miske et al. | 101/126 |
| 4,938,130 | 7/1990 | Thorpe | 101/126 |
| 4,972,773 | 11/1990 | Barlow | 101/127 |
| 4,993,166 | 2/1991 | Bradley | 33/619 |
| 5,094,160 | 3/1992 | Jennings | 101/127.1 |
| 5,094,161 * | 3/1992 | Taylor | 101/129 |
| 5,099,757 | 3/1992 | Jennings | 101/115 |
| 5,188,026 | 2/1993 | Fuqua et al. | 101/129 |
| 5,226,366 | 7/1993 | Schlife et al. | 101/485 |
| 5,315,929 | 5/1994 | Sundqvist | 101/127.1 |
| 5,377,422 | 1/1995 | Newman | 33/620 |
| 5,429,045 * | 7/1995 | Karlyn et al. | 101/41 |
| 5,503,068 | 4/1996 | Newman | 101/126 |
| 5,522,148 | 6/1996 | Newman | 33/620 |
| 5,806,422 | 9/1998 | Hamu | 101/115 |

FOREIGN PATENT DOCUMENTS 0 268 466 A2 5/1988 (EP) .

* cited by examiner

*Primary Examiner*—Ren Yan
(74) *Attorney, Agent, or Firm*—Seidel, Gonda, Lavorgna & Monaco, PC

(57) ABSTRACT

This invention is a retractable registration apparatus (10) mounted on a printing machine (12) for aligning a screen printing frame (28) with an image platform (14). The apparatus (10) has a pair of registration mechanisms, such as pins (64), for coupling with the screen printing frame (28) and a registration appendage (56) which carries the registration mechanism (64). The registration appendage (56) is rotatably mounted to the printing machine (12) for allowing rotation of the registration appendage (56) from a registration position to a retracted position. A locking mechanism, such as a detent (102), retains the appendage (56) with the registration mechanism (64) in the exact registration position.

25 Claims, 29 Drawing Sheets

RETRACTABLE PALLET ATTACHMENT FOR SCREEN PRINTING

The present application is a continuation-in-part of application Ser. No. 08/649,597, filed on Jul. 3, 1996, now abandoned, which is a continuation-in-part of application Ser. No. 08/329,022, filed on Oct. 25, 1994, now U.S. Pat. No. 5,503,068.

FIELD OF THE INVENTION

This invention relates to a retractable registration system for aligning a screen printing frame and screen in a printing machine, and more particularly to a registration system that retracts under the pallet allowing ease of insertion of a substrate, such as a shirt, without removing the registration system.

BACKGROUND OF THE INVENTION

In the majority of screen printing operations, more than one color is used to create the desired image. The use of more than one color results in using several screens, one for each color, wherein each screen has the associated image for that color. It is therefore necessary to ensure that the images from each screen align properly so that the associated colors align properly. This is typically done by ensuring that the screen is properly aligned in a frame and aligning the frame, such as a roller frame, to a platform, such as a pallet, which receives the article that is to receive the image.

One conventional method is to remove the pallet from the screen printing machine and install a fixture that has a series of pins. These pins are used to align the screen printing roller frame and screen in the machine. The screen printing roller frame is mounted on a flat bar having a hole and a slot in which to receive the pins, therein aligning the frame on the pallet. With the screen aligned, a frame holder having a U-shaped channel is secured to the screen printing roller frame, typically by lowering a bracket into engagement with the frame. With the frame secured in the frame holder, the frame and the pallet are moved relative to each other to separate them by either lowering the pallet or raising the frame with the frame holder. Depending on the type of machine either the pallet or the frame holders are rotated and another screen is inserted on the fixture and aligned with a second frame holder. After alignment of all the screens with the frame holder, the printer removes the fixture from the machine and reinstalls the pallet used for printing.

One of the shortcomings, in addition to the time required to remove the pallet and install the fixture, is that the installation and removal of the pallet and the fixture results in wear to those parts used to secure the fixture or pallet to a pallet arm. In addition, the printer must have a location to store the fixture when not being used to align the screen printing roller frame.

It is desired to have a registration system that would allow for quick registration of a screen printing roller frame and screen and in addition allow the registration means to retract without removal from the machine.

SUMMARY OF THE INVENTION

The present invention relates to a retractable registration apparatus mounted on a printing machine for aligning a screen printing frame with an image platform. The apparatus has a pair of registration mechanism, such as pins, for coupling with the screen printing frame and a registration appendage which carries the registration mechanism. The registration appendage is rotatably mounted to the printing machine for allowing rotation of the registration appendage from a registration position to a retracted position. A locking mechanism, such as a detent, retains the appendage with the registration mechanism in the exact registration position.

In a preferred embodiment, the retractable registration apparatus has a pair of registration appendages, each appendages has an arm and a finger extending from the arm. Each arm has at least two sections with a substantially square cross-section along a longitudinal axis of the arm and at least two other sections along the longitudinal axis, having a circular cross-section inscribed within the square cross-section. A pair of mounting brackets are associated with each of the arms. The mounting brackets each have a substantially square opening extending through the bracket for slideably receiving the substantially square cross-section of the arm. The substantially square openings each have a pair of side walls. The pair of mounting brackets are mounted to the lower surface of the image platform so that one of the side walls of each of the brackets are aligned in the same plane and are parallel to the center line. Each arm has a track formed within the arm, and one of the mounting brackets associated with the arm has a guide pin projecting into the arm for guiding the movement of the arm. The track has portions with a longitudinal component for movement of the arm in a translational movement and has portions having a radial component for rotation of the arm about the longitudinal axis. Each finger extending from the arm has at least one registration pin for registration with the screen frame. The apparatus has a means for retaining the arms and the registration pins in the retracted position, and means for retaining in the exact registration position, the arms and the registration pins for aligning the screen frame.

In other preferred embodiments, the retractable registration apparatus has a pair of registration appendages. Each appendage has an arm and a finger portion extending from the arm. The finger portion has at least one registration mechanism, such as pin, for coupling with the screen printing frame The arm is pivotably mounted to a plate. The plate is mounted to a lower mounting surface of the image platform, pallet. The arm in one preferred embodiment rotates horizontally from the retracted position to the registration position and the finger rotates relative to the arm. The arm in another preferred embodiment rotates vertically from the retracted position to the registration position and the finger is part of the arm and does not rotate relative to the rest of the arm.

In another preferred embodiment, the retractable registration apparatus has a registration appendage. The registration appendage has an arm and a transverse bar. The transverse bar is secured to the arm and carries a pair of registration mechanisms, such as a pair of registration pins for engaging the printing screen frame. The arm is pivotable mounted to the pallet arm for rotation between the registration position and the retracted position. The arm has a pair of parallel bars. A stop is located between the bars of the arm for positioning the arm and at least one detent mechanism for engaging a bracket carried by the image platform.

One object, feature and advantage of the present invention is that the image platform, such as a pallet, does not have to be removed from the machine in order to install a fixture to align the screen printing roller frame, therein reducing the added wear on the mechanism retaining the pallet to the machine.

Another object, feature and advantage of the present invention in several embodiments resides in the fingers in the retracted position under the pallet do not interfere with the insertion of an article such as a shirt onto the image platform for printing.

Further objects, features and advantages of the present invention will become more apparent to those skilled in the art as the nature of the invention is better understood from the accompanying drawings and detailed descriptions.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
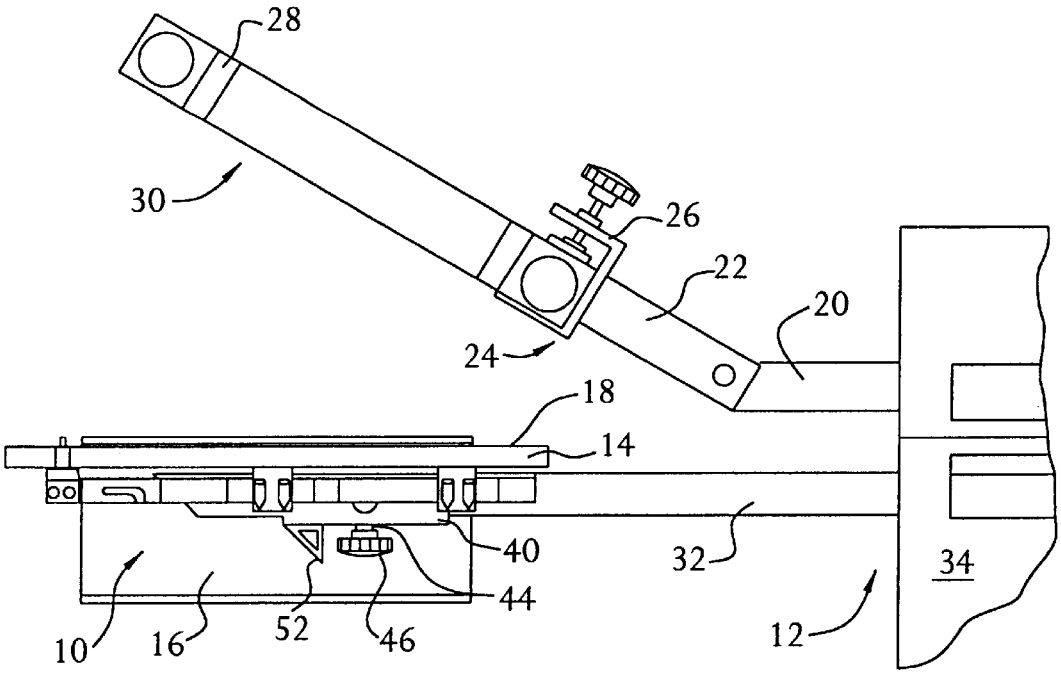
FIG. 1 is a side elevational view of a screen printing machine having an image platform, such as a pallet, of the present invention, and a screen printing frame attached to a frame holder.

Referring to the drawings in detail, where like numerals indicate like elements, there is illustrated a device in accordance with the present invention designated generally as 10.

Referring to FIG. 1, a printing machine 12 has an image platform 14, such as a pallet, for receiving an article 16 to print on, such as a shirt or poster. The portion of the article to be printed on, lies on top of an upper printing surface 18 of the pallet 14. The printing machine 12 has a stationary bar 20 and a movable bar 22. At the end of the movable bar 22 is a frame holder 24 having a U-shaped channel 26. The U-shaped channel 26 of the frame holder 24 receives a screen printing frame, such as a roller frame 28, having a screen mesh 30 which contains an image to be transferred to the shirt 16.

The pallet 14 is linked to the frame holder 24 by a pallet arm 32 extending from a central portion 34 of the printing machine 12 to the pallet 14. The printing machine 12 has a mechanism for separating the frame holder 24 from the pallet 14, and in this embodiment the pivotal movement of the movable bar 22 relative to the stationary bar 20 raises the frame holder 24, with screen printing roller frame 28, away from the pallet 14. In addition, the central portion 34 of the printing machine 12 allows rotation of the pallet 14 and pallet arm 32 relative to the frame holder 24 to move another pallet 14, not shown, underneath the same screen printing roller frame 28 therein moving the pallet 14 to another station that may have another screen printing frame.

Figure 2:
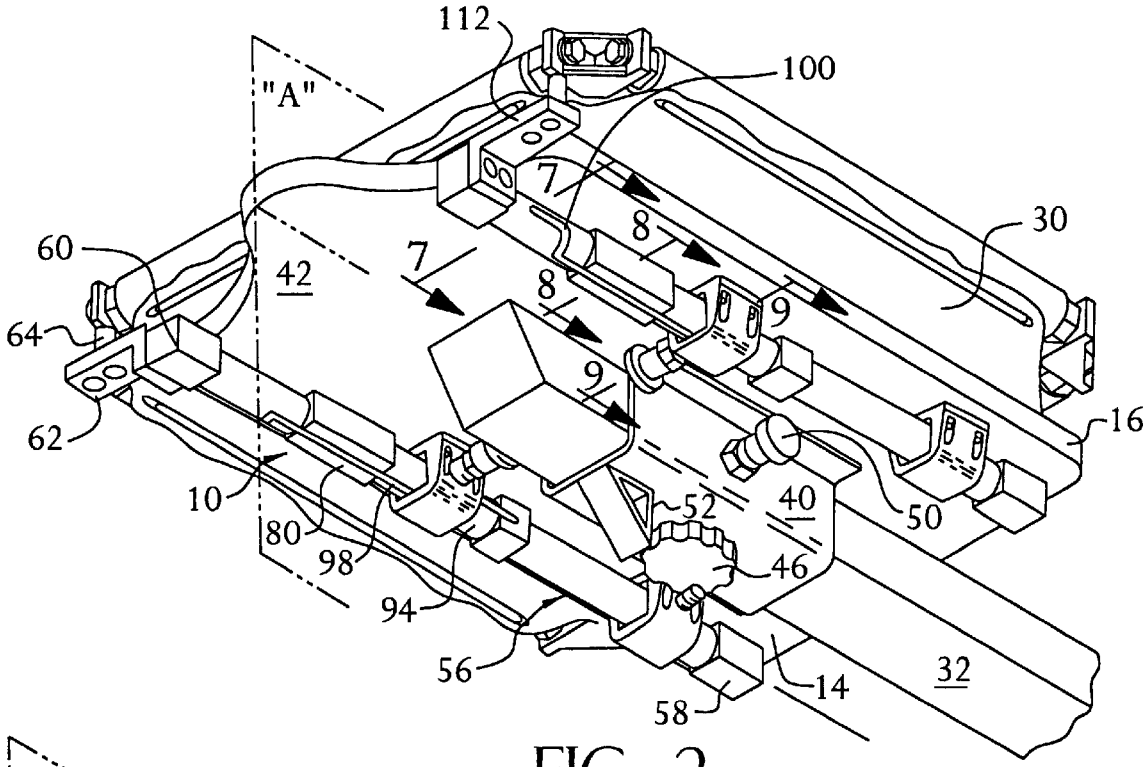
FIG. 2 is a bottom isometric view of the pallet having a pallet arm located in the bracket and the registration appendages in a registered position.
Figure 3:
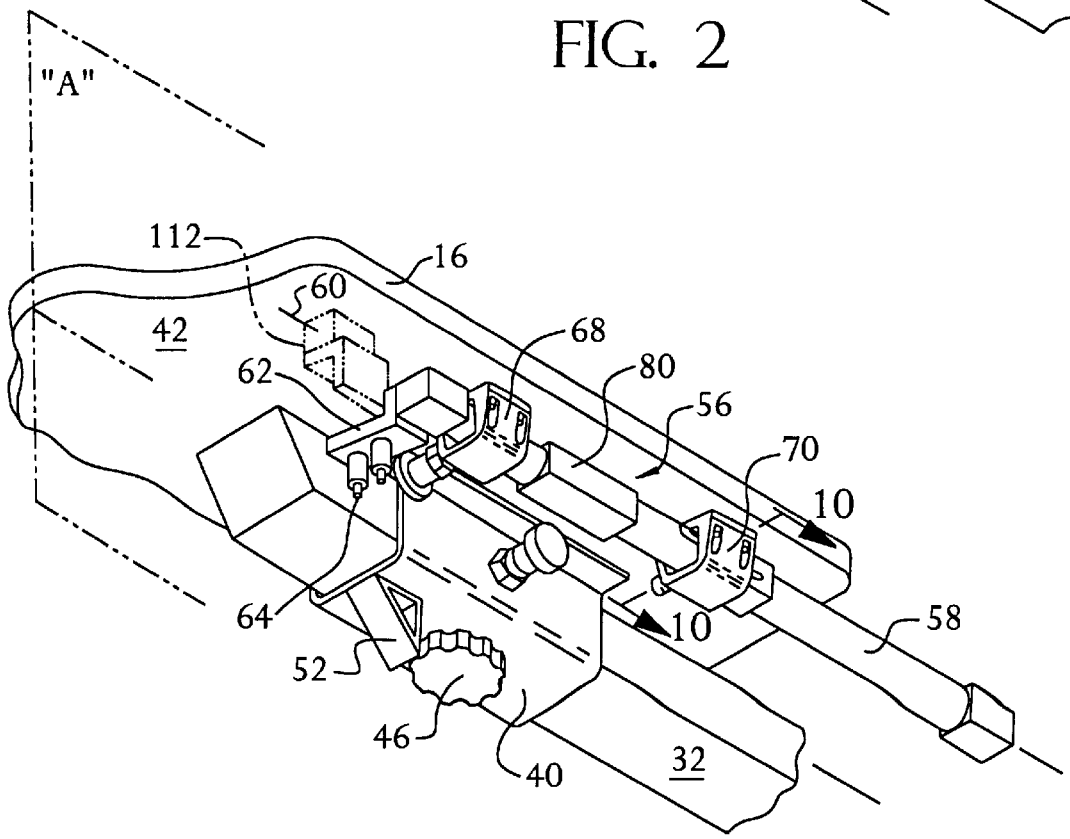
FIG. 3 is a bottom isometric view of a portion of the pallet with the registration appendages shown in a retracted position.

Referring to FIGS. 1–3, the pallet 14 is mounted to the pallet arm 32 by a U-shaped bracket 40. The U-shaped bracket 40 is mounted to a lower mounting surface 42 of the pallet 14 along the center line or plane "A" of the pallet 14. The U-shaped bracket 40 has a threaded screw 44, as seen in FIG. 1, with a knurled knob 46 for engaging the pallet arm 32 to secure the pallet 14 in position on the pallet arm 32. The end, not shown, of the threaded screw 44, frictionally engages the pallet arm 32 to hold the pallet 14 relative to the pallet arm 32 and the frame holder 24. In addition, the U-shaped bracket 40 has a second threaded shaft, not shown, with a knurled knob 50 engaging the side of the pallet arm 32 to secure the pallet 14 in position.

The U-shaped bracket 40, in addition, has an angled bracket 52 located in front of knurled knob 46 to ease the placement of article 16, such as a shirt, as seen in FIG. 1, around the pallet 14 to allow printing on the upper printing surface 18. The pallet arm 32 has an angled front, also for ease in placement of the shirt 16 around the pallet 14.

Mounted on the lower mounting surface 42 of the pallet 14 is the retractable registration apparatus 10. The retractable registration apparatus 10 has a pair of registration appendages 56. Each registration appendage 56 has an arm 58 which extends along a longitudinal axis 60. Projecting from the arm 58, perpendicularly to the longitudinal axis 60, is a finger 62 having a plurality of pins 64.

Figure 5:
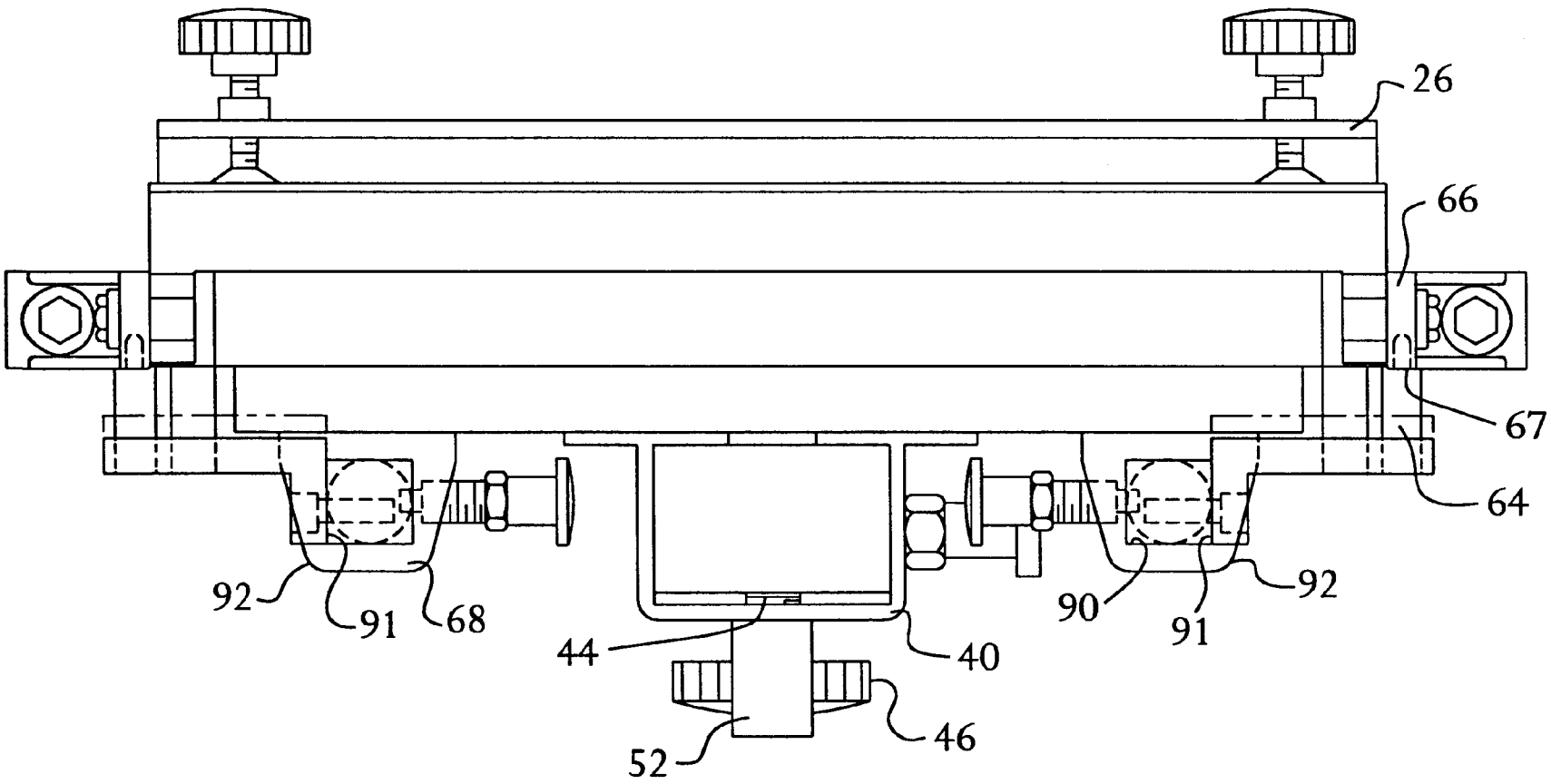
FIG. 5 is a front elevational view of the pallet with the registration appendages in the registered position and pins engaging the frame.

The retractable registration apparatus 10 is shown in a registration position in FIG. 2 for aligning the screen printing roller frame 28 in the printing machine 12. The screen printing roller frame 28 has corner members 66 having a hole or slot 67, as best seen in FIG. 5. U.S. Pat. Nos. 5,377,422 and 08/347,757 disclose a screen printing roller frame having an adapter or corner member having a hole and a slot and is herein incorporated by reference. The outer pins 64 on each finger 62, in this particular embodiment, are received by a hole or slot in the corner member 66 to align the screen printing roller frame 28 so that it may be secured in the U-shaped channel 26 of the frame holder 24.

Referring to FIG. 3, the retractable registration apparatus 10 is shown in a retracted position allowing printing. In the retracted position, the pallet 14 can be used for printing without interference from the registration apparatus 10. Each of the arms 58 is mounted to the lower mounting surface 42 of the pallet 14 by a pair of mounting brackets 68 and 70. In that the registration appendages 56 are mirror images of each other, only one of the appendages 56 will be described.

Figure 4:
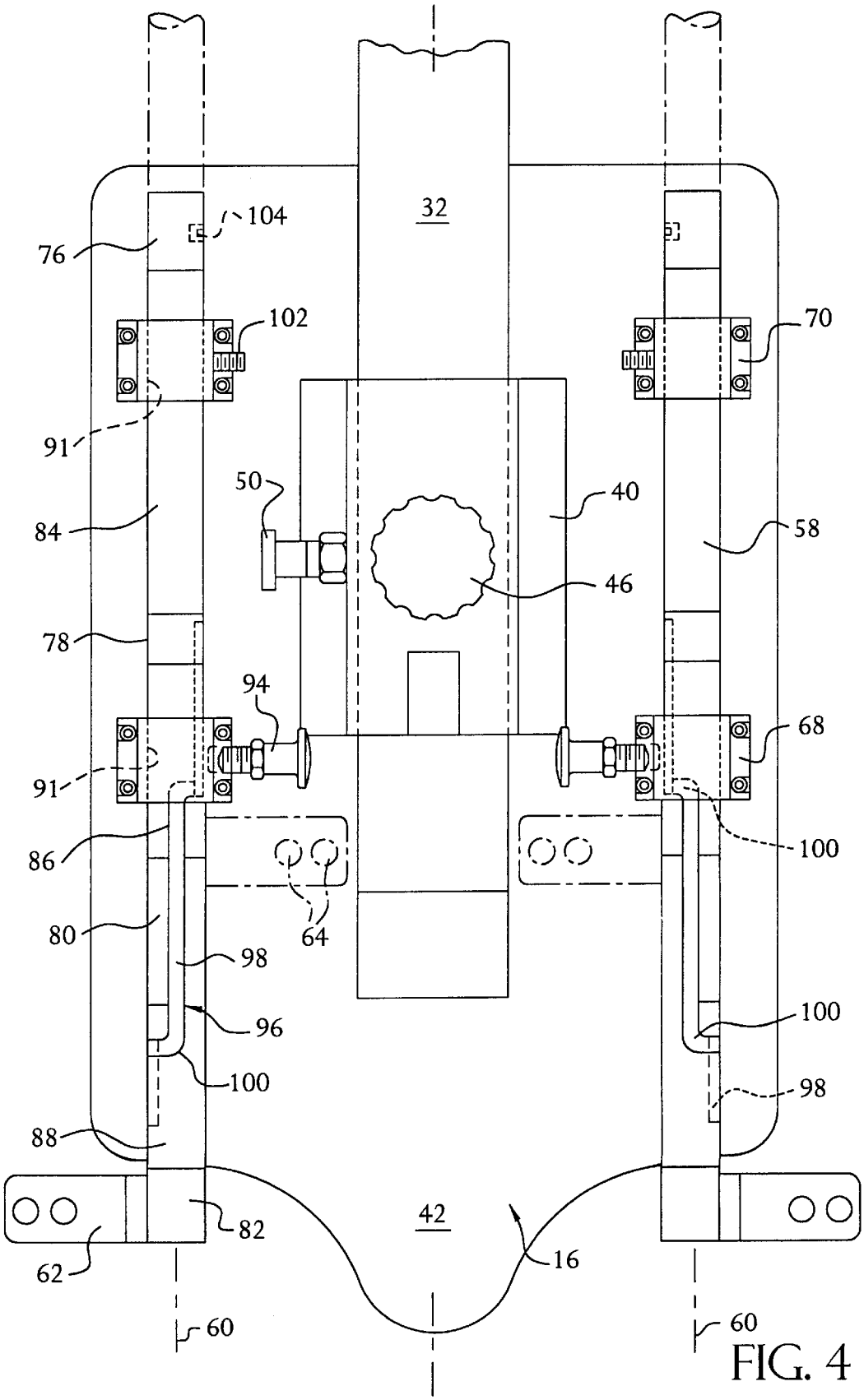
FIG. 4 is a bottom plan view of the pallet with the registration appendages in the registered position. The registration appendages are shown in phantom in the retracted position.

Referring to FIG. 4, the arm 58 has four sections that each have a square cross-section. The square cross-sections each have four edges 74 which are rounded, as seen in FIGS. 7–10. The four sections are a rear alignment section 76, a front alignment section 78, a sliding section 80 and a mounting section or portion 82. Between the rectangular cross-sections, the arm 58 has circular cross-sections which inscribe the square cross-sections. The circular cross-sections are a detent section 84, a second rotation section 86 and a first rotation section 88.

Referring to FIGS. 4 and 5, the mounting brackets 68 and 70 have a square opening, or bushing having an opening 90, for slideably receiving the square cross-sections 76, 78 and 80 of the arm 58. The mounting brackets 68 and 70 are mounted to the lower mounting surface 42 of the pallet 14 such that side walls 91 of each of the mounting brackets 68 and 70 are aligned in the same plane and parallel to the center line "A" of the pallet 14. In addition, the mounting brackets 68 and 70 each have a tapered outer wall 92 to ease the insertion of a shirt 16 on the pallet 14, as described below.

The front mounting bracket 68 has a tracking pin 94 to be received in a track 96 cut into the arm 58. The track 96 has longitudinal extending portions 98 for allowing translational movement of the registration appendage 56, including the arm 58 and the finger 62. In addition, the track 96 has portions 100 having a radial component for allowing rotation of the arm 58 and the finger 62 about the longitudinal axis 60.

Referring to FIG. 4, the back mounting bracket 70 has a detent mechanism, such as a detent 102 or a pull out plunger. The detent 102 aligns with a detent bushing 104, shown in hidden line, located on one of the sides of the square cross-section rear alignment section 76 of the arm 58 to retain the registration appendages 56 with the finger 62 in the registration position.

Figure 10:
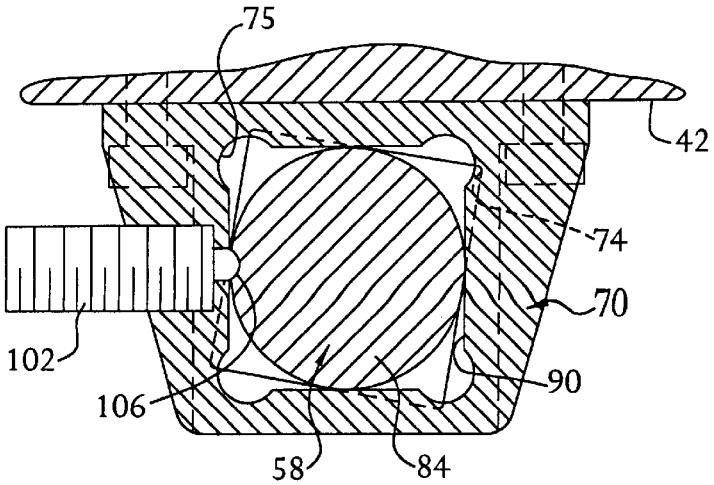
FIG. 10 is a sectional view of the arm and a rear mounting bracket taken along line 10—10 in FIG. 3.

Referring to FIG. 10, the detent 102 engages a dimple 106 on the detent section 84, a circle cross-section of the arm 58, to retain the registration appendages 56, including the finger 62 in the retracted position. The corners of the square opening 90 of the mounting brackets 68 and 70 are relieved by a ¾ circle cutout which allows the square cross-sections of the arm 58 to slide easily against the walls of the square opening 90 including the side walls 91. In addition, the square cross-section portions of the arm 58 have their edges broken or rounded to ease in the sliding of the arm 58 and reduce cost in manufacturing.

Figure 6:
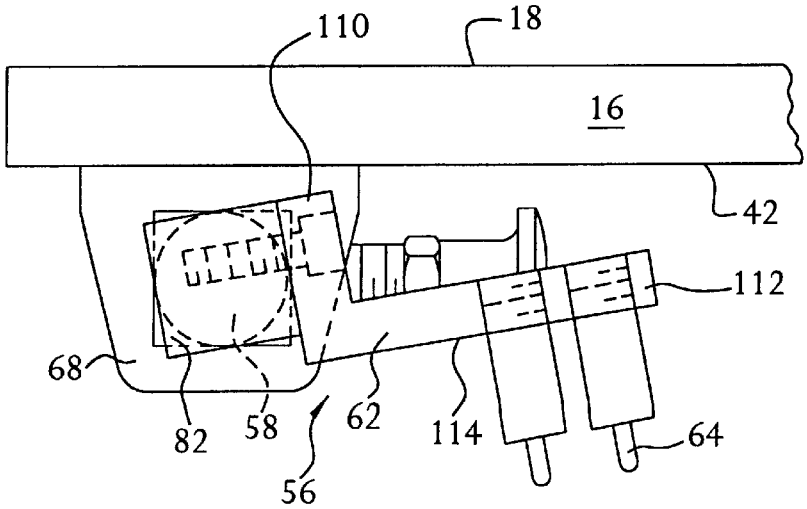
FIG. 6 is an enlarged broken out front elevation view of the finger and arm in the retracted position.

Referring to FIG. 6, the finger 62 has a leg segment 110 that is secured to the square cross-section mounting portion 82 of the arm 58 and a second leg segment 112 that projects perpendicularly from the longitudinal axis 60 of the arm 58. The second leg section 112 has an upper surface 114 which is parallel to one of the sides of the square cross-section of the mounting portion 82 and spaced vertically therefrom.

When the registration appendage 56 is in the registration position as shown in FIG. 5, the upper surface 114 of the second leg 112 of the finger 62 can project above the lower mounting surface 42 of the pallet 14 as shown in phantom. Projecting from the upper surface 114 of the second leg segment 112 is the pair of registration pins 64. The preferred pins 64 are spring pins in which the pins can recede if they engage a hard surface, such as the screen printing roller frame 28.

In operation

Figure 7:
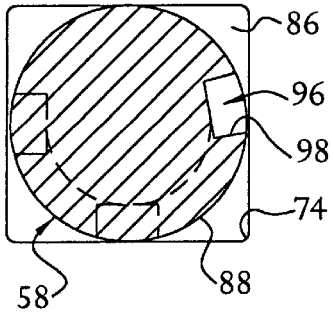
FIG. 7 is a sectional view of the arm taken along 7—7 in FIG. 2.

Referring to FIG. 3, when a screen printing roller frame 28 is to be aligned and secured to the frame holder 24 to set up for a printing operation, a printer grasps the fingers 62 located below the lower mounting surface 42 of the pallet 14 and pulls the registration appendages 56 towards him or herself. The tracking pin 94 of each registration appendage 56 follows the longitudinal portion 98 of the track 96, as shown in FIG. 7.

Figure 9:
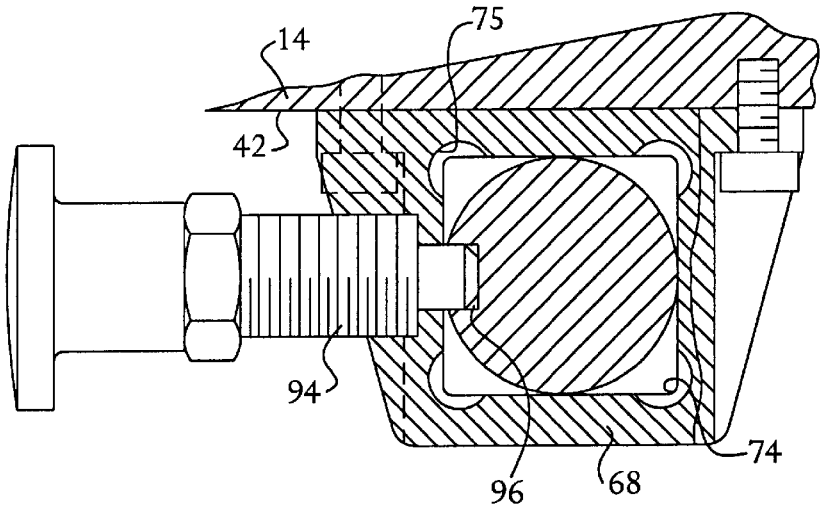
FIG. 9 is a sectional view of the arm and a front mounting bracket taken along line 9—9 in FIG. 2.

When the tracking pin 94 reaches the radial portion 100 of the track 96 in the first rotation section 88, referring to FIGS. 4 and 2, the printer rotates the finger 62 105°. After the rotation, the second leg segment 112 of the finger 62 is projecting downward and the square cross-sections of the arm 58 are aligned with the side walls 91 of the square opening 90 of the mounting brackets 68 and 70. The mounting brackets 60 and 70 each have reliefs at the corners of the square openings 90 to ease movement, as seen in FIGS. 9 and 10.

Figure 8:
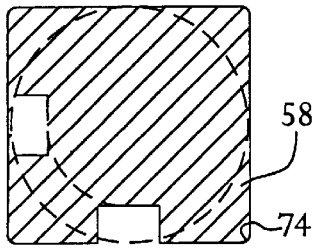
FIG. 8 is a sectional view of the arm taken along line 8—8 in FIG. 2.

Referring to FIG. 3 wherein the second leg segment 112 is shown in phantom projecting downward, and FIGS. 4 and 8, after the rotation of the arm 58 about the longitudinal axis 60, the sliding section cross-section 80 slides through the front mounting bracket 68 and the front alignment section 78 slides through the rear mounting bracket 70 moving the registration appendage 56 including arm 58 and finger 62 outward toward the printer. The tracking pin 94 reaches a second portion having a radial component 100, located in the second rotation section 86. The printer rotates the finger 62 about the longitudinal axis 60, such that the second leg segment 112 is parallel with the upper printing surface 18 of the pallet 14 as shown in FIGS. 2, 5 and 1.

Referring to FIGS. 2 and 5, upon the completion of this rotation, the tracking pin 94 reaches a portion of the track 96 that has strictly a longitudinal component 98. The arm 58 and finger 62 are pulled further outward until the registration appendages 56 reach the registration position. In the registration position, the detent 102 in the rear mounting bracket 70 engages the detent bushing 104 in the rear alignment section 76 therein securing the plurality of pins 64 in the proper position for alignment of the screen printing roller frame 28.

Referring to FIGS. 1 and 2, with the registration appendage 56 in proper registration position, the screen printing roller frame 28 is placed on the upper printing surface 18 of the pallet 14, with the pins 64 received by holes or slots 67 in the screen printing roller frame 28 by moving a flat bar from a substrate loading position to a printing position. With the screen printing roller frame 28 aligned, the frame holder 24 secures the roller frame 28. The movable bar 22 is raised upward lifting the screen printing roller frame 28 away from the pallet 14 and the pins 64.

The printing machine 12 is rotated such that a different frame holder 24 is located above the pallet 14 having the pin 64. The movable bar 22 associated with this different frame holder 24 is lowered down on the pallet 14. A second screen printing roller frame 28 is installed with the screen printing roller frame 28 located in the frame holder 24. The screen printing roller frame 28 is placed with the pins 64 of the registration appendages 56 received by holes or slots 67 in the screen printing roller frame 28. The process is repeated until all of the screen printing roller frame 28 are aligned and secured in the frame holder 24.

After all the screen printing roller frames 28 are aligned, the printer pushes the fingers 62 of the registration appendage 56 inward with the tracking pin 94 guided in the longitudinal portion 98 of the track 96 in the first alignment section 78 and second rotation section 86. When the tracking pin 94 reaches the radial component 100 of the track 96 in the second rotation section 86, the printer rotates the registration appendage 56 including the arm 58 90°.

The printer continues to push the fingers 62 inward with the tracking pin 94 following the longitudinal portion 98 of the track 96 in the second rotation section 86, the square cross-section sliding section 80 and the first rotation section 88. With the tracking pin 94 at the other radial component 100 of the track 96 in the first rotation section 88, the registration appendage 56 is rotated 105° until the finger 62 is in the retracted position 62 as shown in FIG. 6.

The printer continues to slide the registration appendage 56 inward until the arm 58 is retained in the retracted position 62 by the detent 102 being received by the dimple 106, as shown in FIG. 10. The registration appendage 56 is shown in the retracted position in FIG. 3 and in phantom in FIG. 4. In order to ease the finding of both the detent bushing 104 and the dimple 106 by the detent 102, the track 96 is cut in the arm 58 such that the ends of the track 96 extend beyond where the detent 102 would be located in the retracted position and the registered position by just hundredths of inches.

The printer then slides the article such as a shirt 16 onto the pallet 14 with the taper outer walls 92 of the mounting brackets 68 and 70 and in addition the angle bracket 52 of the U-shaped bracket 40 creating surfaces that will minimize the likelihood that the shirt 16 will get caught upon installation. The fingers 62 and the pins 64 of the registration appendages 56 are located between the arm 58 and the pillar arm 32 so as not to interfere with the sliding of the shirt onto the pallet 14.

The printer lowers the frame holder 24 containing the screen printing roller frame 28 and passes a squeegee across the screen mesh 30 to place an image on the shirt 16. The screen printing roller frame 28 and frame holder 24 are separated from the pallet 14 and the printing machine 12 is rotated such that another screen printing roller frame 28 containing a different image on screen mesh 30 is located above the pallet 14 containing the shirt 16 and the printing process continues.

Alternatives to the First Embodiments

Figure 11:
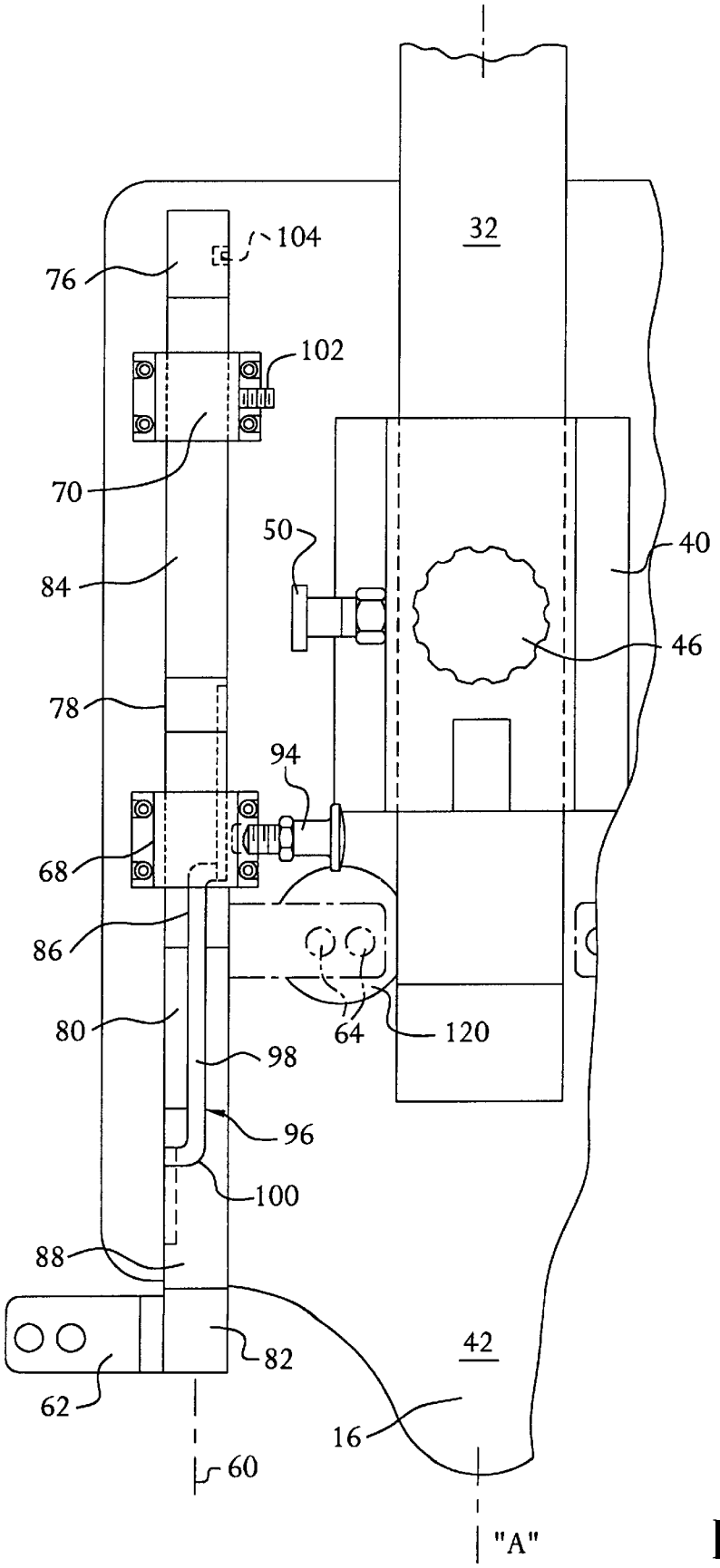
FIG. 11 is a bottom plan view of the pallet with the registration appendages in the registered position showing an alternative track.

Referring to FIG. 11, the radial component 100 of the track 96 has a longitudinal component 98. With the radial component 100 having the longitudinal component 98, the arm 58 of the registration appendage 56 will slide more smoothly between the retracted position and the registration position. The track 96 will guide the printers movement of the registration appendage 56.

In addition, the pallet 14 has a depression 120 cut into the lower mounting surface 42. The depression 120 allows the finger 62 to be rotated further, therein decreasing the likelihood that the pins 64 which project from the finger 62 will inadvertently catch on the shirt 16 being slid onto the pallet 14 to be printed on.

Figure 12:
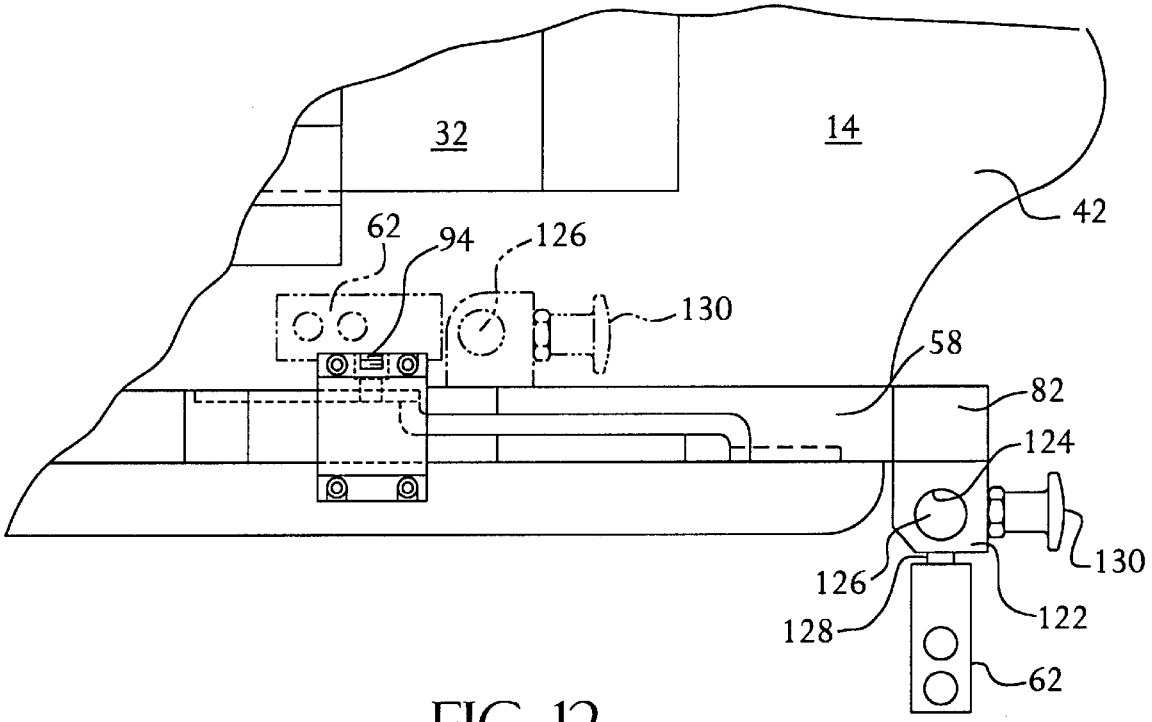
FIG. 12 is a bottom plan view of the pallet with the registration appendages showing an alternative finger in the registration position. The finger is shown in phantom in the retracted position.
Figure 13:
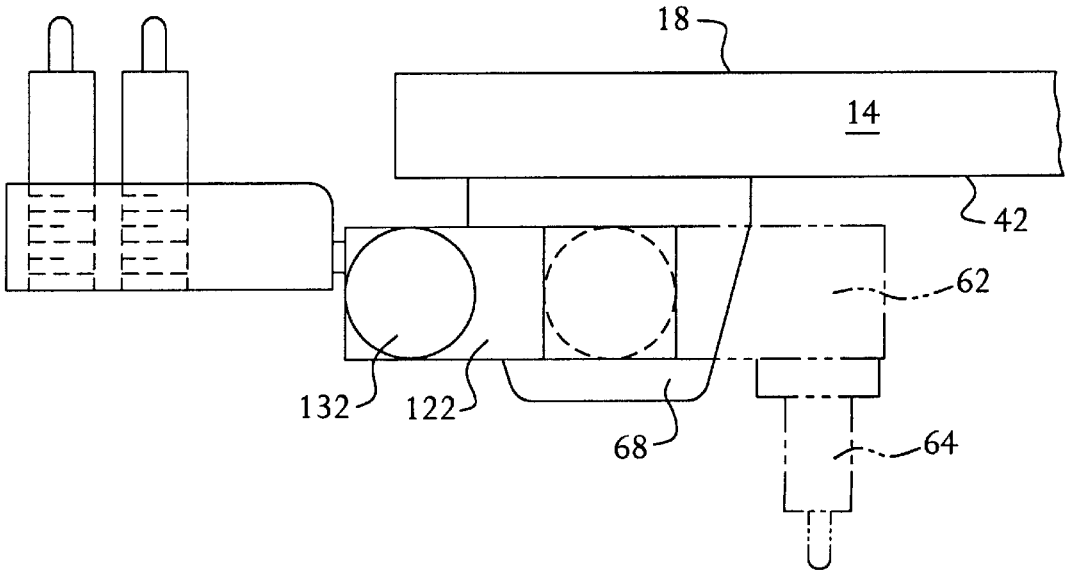
FIG. 13 is an enlarged broken out front elevational view of the finger and arm in the registration position of an alternative of the first embodiment shown in FIG. 12. The finger is shown in phantom in the retracted position.

Referring to FIGS. 12 and 13, the finger 62 is pivotably mounted to the mounting section 82 of the arm 58. The mounting section 82 has an extension 122. The extension 122 has a bore 124 for receiving a pivot 126. The finger 62 has a hinge arm 128 that is connected to the pivot 126. The finger 62 rotates between an extended registration position and a rotated retracted position shown in phantom in FIGS. 12 and 13. The extension 122 has a detent plunger 130 for engaging detent dimples, not shown, on the pivot for retaining the finger 62 in its two positions. This embodiment allows the pins 64 to extend further outward without the finger 62 interfering with the pallet arm 32 when in the retracted position. A different type tracking pin 94 is shown in FIG. 12 which does not extend as far outward towards the pallet arm and therefore does not interfere with the rotated finger 62.

Figure 14:
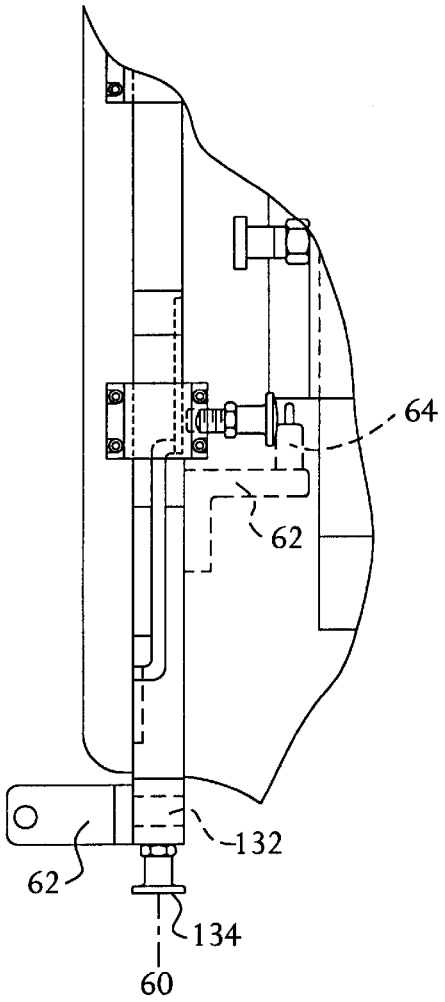
FIG. 14 is a broken out bottom plan view of the pallet with the registration appendages showing an alternative finger in the registration position. The finger is shown in phantom in the retracted position.

It is also realized that the finger 62 could be attached to the arm 58 such that the finger 62 can rotate relative to the arm 58, perpendicular to the longitudinal axis 60 of the arm 58 by having a cylindrical shaft 132, as shown in hidden line in FIG. 14, extending through the mounting section 82 of the arm 58. A detent mechanism 134 would hold the finger 62 in an extended position or a retracted position. For example, the finger 62 could be rotated 90° so that the pins are perpendicular to the printing surface therein not interfering with the installation of a shirt 16 for printing as shown in phantom in FIG. 14.

It is also recognized that the finger 62 could have a telescoping arrangement. The telescoping arrangement would allow the pins to be extended further outward in the registration position, but not interfere with the pallet arm 32 in the retracted position.

While each arm 58 is shown with a track 96, and separate detent bushing 104 and dimple 106, the track 96 could have locations in where the track is cut deeper than the rest of the track. These two locations therein forming each a detent and the tracking pin 94 could act as both the tracking pin and the detent.

Figure 15:
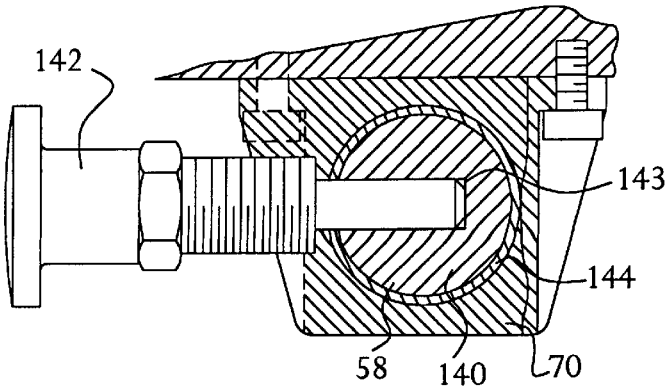
FIG. 15 is a sectional view of an alternative embodiment of the arm and mounting bracket.

It is recognized that while the registration appendage 56 has been shown having both square cross-sections and circular cross-sections, the arm could be a uniform circular cross-section 140 as shown in FIG. 15. With the uniform circular cross-section 140, the tracking pin 94 guides the movement of the arm 58 as in the previous embodiment. A detent 142 extends into a hole 143 in the circular cross-section 140 to hold the registration appendage 56 in the registration position. Since the square cross-section of the arm 58 in the square opening 90 of the previous embodiment assisted in the prevention of rotation of the arm 58 and such assistance is not available in this embodiment, the hole 143 and the detent 142 is larger to maintain the arm 58 in the registration position. The rear mounting bracket 70 has a brass sintered bushing 144 through which the arm 58 with the uniform circular cross-section 140 slides.

It is recognized that while a tracking pin received in a track to guide the movement of the arm 58, it may be desirable for ease in manufacturing to eliminate the track. If a printer knows the general positions of the retracted position and the registration position, all that would be required in the arm would be the pair of holes which receive detent 142 to align the registration bracket.

Alternative Embodiments

Figure 16:
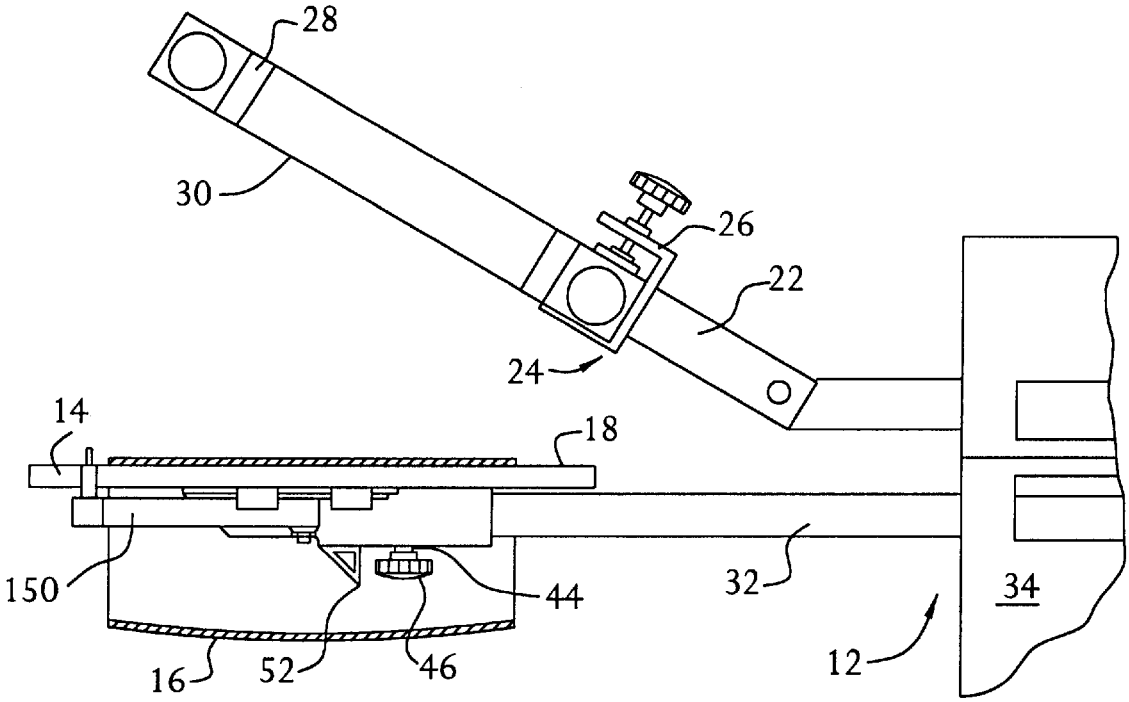
FIG. 16 is a side elevation view of a screen printing machine having an image platform, such as a pallet, with an alternative embodiment of the retractable registration apparatus of the present invention and a screen printing frame attached to a frame holder.

Referring to FIG. 16, an alternative embodiment 150 of the retractable registration apparatus is shown. As of filing, this is the preferred embodiment for an automatic printing machine. Similar to FIG. 1, the printing machine 12 has the pallet 14 for receiving an article 16 to print on, such as a shirt or poster. The portion of the article to be printed on, lies on top of the upper printing surface 18 of the pallet 14. The U-shaped channel 26 of the frame holder 24, which is at the end of the movable bar 22, receives the screen printing frame 28. The screen printing frame 28 has the screen mesh 30 which contains an image to be transferred to the shirt 16.

Still referring to FIG. 16, the pallet 14 is linked to the frame holder 24 by the pallet arm 32 extending from the central portion 34 of the printing machine 12 to the pallet 14. The printing machine 12 has a mechanism for separating the frame holder 24 from the pallet 14, and in this embodiment of the machine, the pivotal movement of the movable bar 22 relative to the stationary bar 20 raises the frame holder 24, with screen printing frame 28, away from the pallet 14. In addition, the central portion 34 of the printing machine 12 allows rotation of the pallet 14 and pallet arm 32 relative to the frame holder 24 to move another pallet 14, not shown, underneath the same screen printing roller frame 28 therein moving the pallet 14 to another station that may have another screen printing roller frame. The movement of the screen printing frame 28 to the pallet 14 is not critical to the invention. A co-pending U.S. patent application titled "IMPROVED FRONT HEAD FOR CAROUSEL SCREEN PRINTING MACHINE" filed on Oct. 25, 1995, describes other style printing machines and is incorporated by reference.

Figure 17:
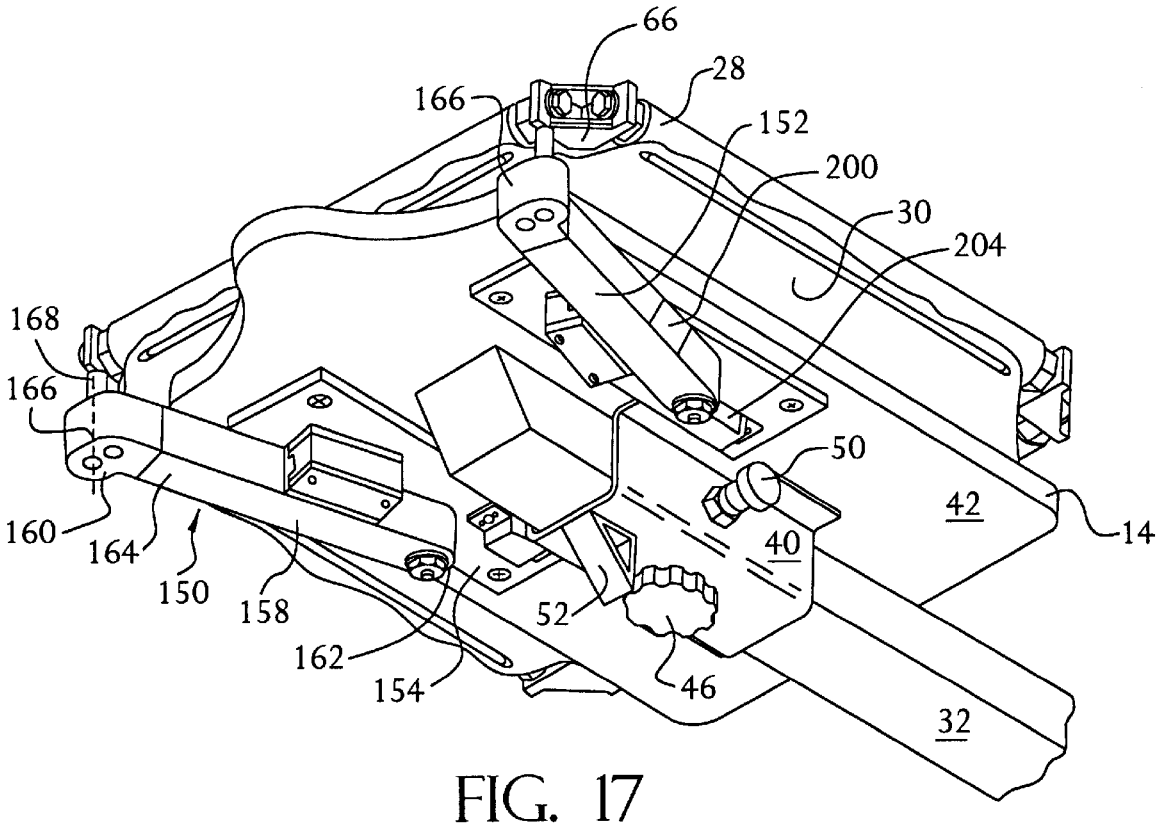
FIG. 17 is a isometric view of the pallet having a pair of registration appendages in a registered position.

Referring to FIG. 17, the pallet 14 is mounted to the pallet arm 32, similarly to the first embodiment, by the U-shaped bracket 40 mounted to the lower mounting surface 42 of the pallet 14 along the center line or plane "A" of the pallet 14. The U-shaped bracket 40 has the threaded screw 44, as seen in FIG. 16, with the knurled knob 46 for engaging the pallet arm 32 to secure the pallet 14 in position on the pallet arm 32. In addition, the U-shaped bracket 40 has the second threaded shaft, not shown, with a knurled knob 50 engaging the side of the pallet arm 32 to secure the pallet 14 in position.

The angled bracket 52 located in front of knurled knob 46 allows the placement of article 16, such as a shirt, with ease as seen in FIG. 16, around the pallet 14 to allow printing on the upper printing surface 18. The pallet arm 32 has an angled front, also for ease in placement of the shirt 16 around the pallet 14.

Mounted on the lower mounting surface 42 of the pallet 14 is the retractable registration apparatus 150. The retractable registration apparatus 150 has a pair of registration appendages 152. Each registration appendage 152 is pivotably mounted to a plate 154. Each plate 154 is secured to the lower mounting surface 42 of the pallet 14. Each registration appendage 152 has an arm 158 and a finger 160. The arm 158 is pivotable mounted at a first end 162 to the pallet 14 and receives the finger 160 at a second end 164. The arm 158 defines a longitudinal axis 166 extending between the two ends 162 and 164. The finger 160 has a plurality of pins 168.

The retractable registration apparatus 150 is shown in a registration position in FIG. 17 for aligning the screen printing frame 28 in the printing machine 12. The finger 160 is in a pin registration position. The screen printing frame 28 has corner members 66 having a hole or slot 67, as best seen in FIG. 5 with respect to the first embodiment. The outer pins 68 on each finger 160, in this particular embodiment, are received by a hole or slot in the corner member 66 to align the screen printing frame 28 so that it may be secured in the U-shaped channel 26 of the frame holder 24.

Figure 18:
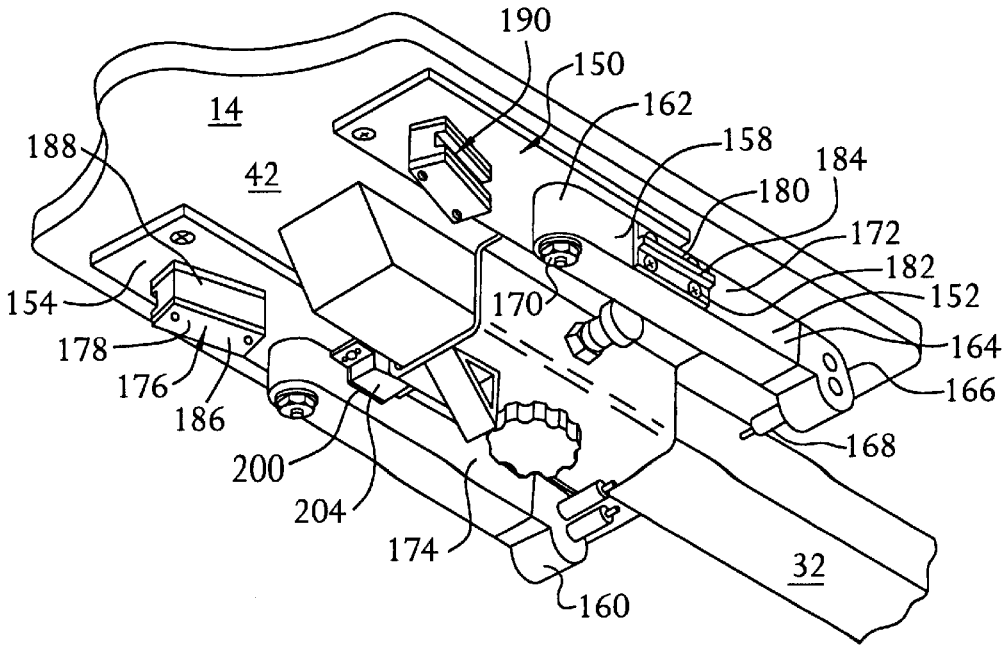
FIG. 18 is a bottom isometric view of the pallet with the registration appendages shown in a retracted position.

Referring to FIG. 18, the retractable registration apparatus 150 is shown in a retracted position therein, allowing for printing. In that the registration appendages 152 are mirror images of each other, only one appendage 152 will be described in detail. In the retracted position, the pallet 14 can be used for printing without interference from the retractable registration apparatus 150. Each of the arms 158 is pivotably mounted at the first end 162 to the plate 154 by a thrust bearing 170. The arm 158 has an inner side surface 172 and outer side surface 174; the names are related to when the arm 158 is in the registration position. The finger 160 is shown rotated to a pin retracted position relative to the arm 158.

The retractable registration apparatus 150 has a locking means, such as a detent mechanism 176, to hold the arm 158 in the registration position. The detent mechanism 176 has a registration position stop 178 mounted to the plate 154 and a registration positioner 180 mounted to the inner side surface 172 of the arm 158. The registration positioner 180 is secured to the arm 158 by a plurality of fasteners 182 and has a protrusion 184. The registration position stop 178 has a pair of plates 186 with an interposed bar 188 having a channel 190 adapted to receive the protrusion 184 from the registration positioner 180. A pin projecting from the positioner or the stop which is received by an opening on the other, or another alignment mechanism can replace the protrusion and channel to support the arm 158 vertically. The registration position stop 178 is positioned on the plate 154 for proper alignment of the pins 168 when the arm 158 is in the registration position.

Figure 19:
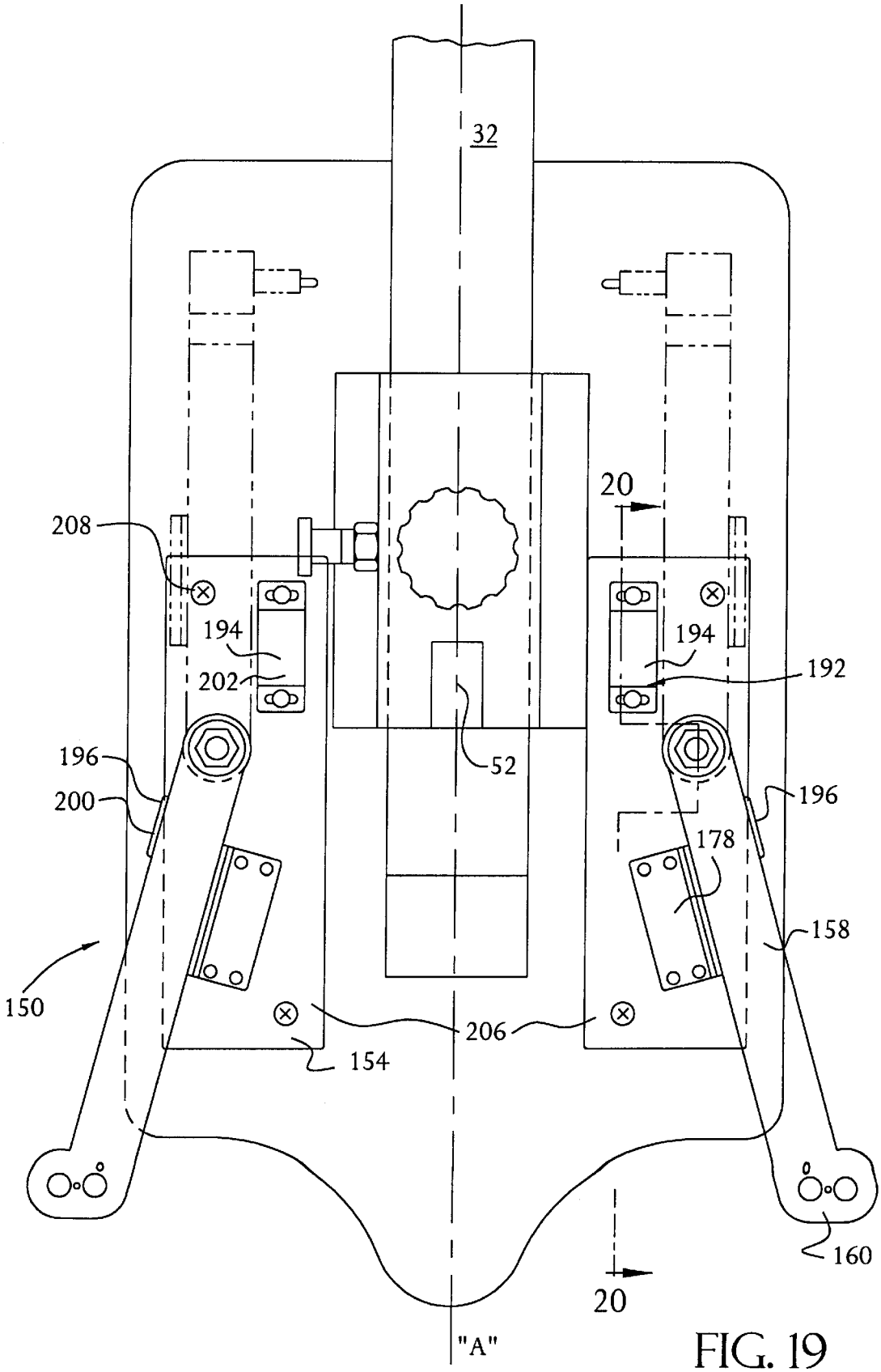
FIG. 19 is a bottom plan view of the pallet with the registration apparatus in the registration position. The registration appendages are shown in phantom in the retracted position.
Figure 20:
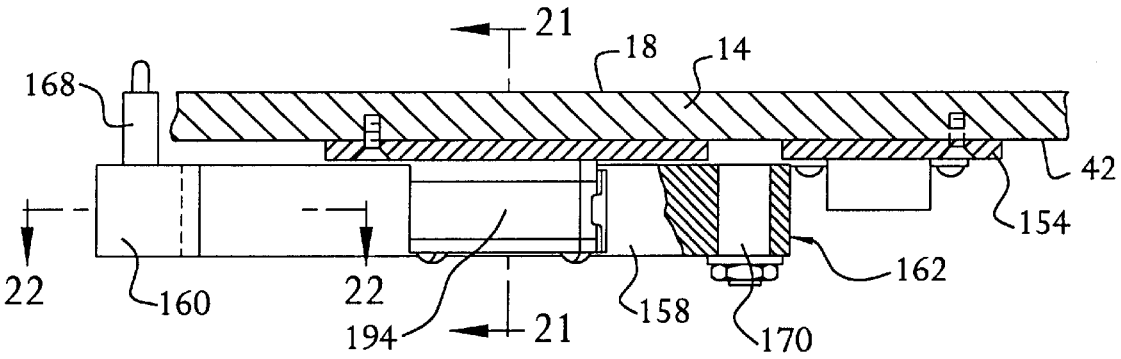
FIG. 20 is a sectional view of the pallet and registration appendages taken along the line 20—20 in FIG. 19.

As best seen in FIGS. 19 and 20, the retractable registration apparatus has a second locking means, such as a detent 192, to hold the arm 158 in the retracted position. The detent 192 has a retracted position stop 194 mounted to the plate 154 and a retracted positioner 196 mounted to the outer side surface 174 of the arm 158. The retracted positioner 196 is secured to the arm by a pair of fasteners (not shown). The retracted positioner 196 is flat plate 200 and has no protrusion. The retracted position stop 194 has a holder 202 which contains a latch mechanism such as a magnet 204.

In a preferred embodiment, the arm 158 is aluminum and the positioners 180 and 196 are of a ferrous material. The interposed bar 188 of the registration position stop 178 is a magnet. In a preferred embodiment, the force exerted by the magnet is fifty (50) pounds. The force exerted by the magnet 204 of the retracted position stop 194 is ten (10) pounds.

Referring to FIG. 19, the retractable registration apparatus 150 is shown in the registration position. The retractable registration apparatus 150 is shown in phantom in the retracted position. Each of the plates 154 are mounted to the lower mounting surface 42 of the pallet 14 such that an inner edge 206 is parallel to and spaced equally from the center line "A" of the pallet 14. In a preferred embodiment, the plates 154 are glued and secured by fasteners 208 to the pallet 14 after being positioned by a jig, not shown.

The arm 158 of the retractable registration apparatus 150 is mounted to the plate 154 by the thrust bearing 170. The thrust bearing 170 ensures that the arm 158 does not move vertically out of the plane, particularly the second end 164 which is cantilevered. The arm 158 is held in the registration position by the protrusion 184 of the registration positioner 180 located in the channel 190 of the registration position stop 178. The finger 160 is rotated to the pin registration position such that the pins 168 can couple with the openings 67 in the screen printing frame 28, as seen in FIG. 17.

The arm 158 is held in the retracted position, as shown in phantom, by the retracted positioner 180 engaging the registration position stop 178. The finger 160 is shown in phantom rotated to the pin retracted position such that is no interference between the pins 68 and the pallet 14.

FIG. 20 shows a sectional view taken along line 20—20 of FIG. 19. The thrust bearing 170 is mounted to the plate 154 and positions the arm 158 in spaced relation from the plate 154 such that the arm 158 is pivotable about the first end 162. The retracted positioner 196 has a magnet, not shown, for retaining the arm 158 when in the retracted position. The registration position stop 194 receives the protrusion 184 from the registration positioner 180, not shown in this Figure, for retaining the arm 158 in the registration position as shown. The finger 160 is shown in the pin registration position relative to the arm 158.

Figure 21:
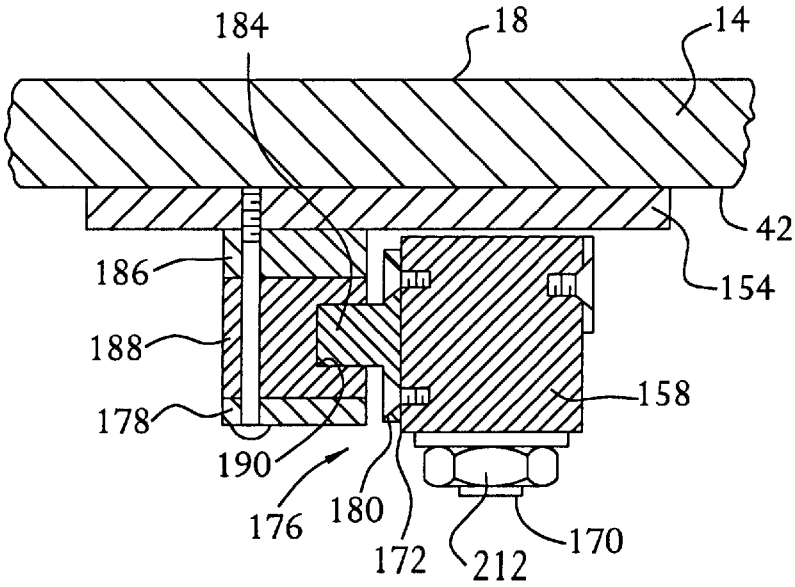
FIG. 21 is a sectional view of the mounting bracket taken along the line 21—21 in FIG. 20.

Referring to FIG. 21, the arm 158 is shown spaced from the pallet 14 by the thrust bearing 170 to allow for movement of the arm 158. The thrust bearing 170 has a nut 212 to secure the arm 158. The detent 176 has the registration position stop 178 mounted to the plate 154 and the registration positioner 180 mounted to the inner side surface 172 of the arm 158 for positioning the arm 158 in the registration position. The channel 190 of the registration position stop 178 is adapted to receive the protrusion 184 of the registration positioner 180, therein locating the arm 158 and assisting supporting the weight of the arm 158 and finger 160. The plates 186 which are located on either side of the magnetic bar 188 having the channel 190 are shown.

While the magnetic bar 188 is shown rigidly attached to the plate 154, it is recognized that the magnetic bar 188 could be mounted to the plates 186 such that it could float into the proper position. In addition, the registration position stop 178 could be mounted to the plate 154 such that the registration position stop 178 location could be varied to vary the registration position. One such way to vary the position is to have one end of the registration position stop 194 mounted and the other end positioned use a detent mechanism.

Figure 22:
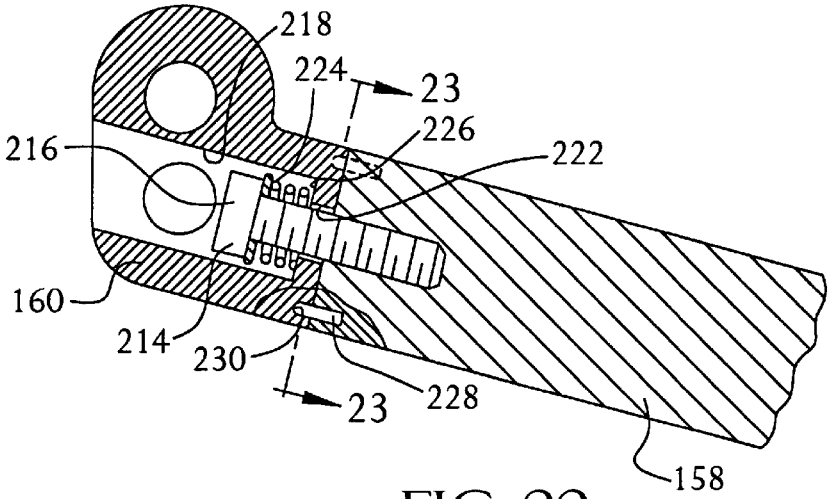
FIG. 22 is a sectional view of the registration appendage taken along the line 22—22 in FIG. 20.
Figure 23:
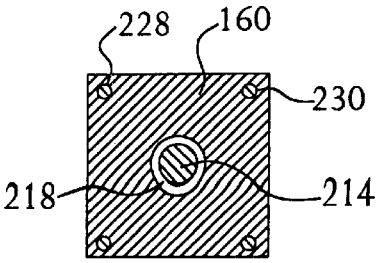
FIG. 23 is a sectional view of the appendage arm/finger interface taken along the line 23—23 of FIG. 22.

Referring to FIG. 22, the finger 160 is secured to the arm 158 by a bolt 214. The bolt 214 has a head 216 which is received by a bore 218 located in the finger 160. The shaft 220 of the bolt 214 extends through a hole 222 in the finger 160 from the bore and is received by the arm 158. A spring 224 located in the bore 218 between the head 216 of the bolt 214 and the floor 226 of the bore 218, biases the finger 160 into engagement with the arm 158. Referring to FIGS. 22 and 23, the arm 158 has a plurality of dowels 228 received by a plurality of holes 230 in the finger 160 for aligning the finger 160 in the pin registration position and the pin retracted position. In a preferred embodiment, the dowels 228 and the finger 160 are machined steel and the arm 158 is aluminum.

In operation

Referring to FIG. 18, when a screen printing frame 28 is to be aligned and secured to the frame holder 24 to set up for a printing operation, a printer grasps the arms 158 located below the lower mounting surface 42 of the pallet 14 and rotates the registration appendages 152 about the thrust bearing 170 towards her or himself and away from the pallet arm 32 and then towards the pallet arm 32. The arms 158 are rotated until the protrusion 184 of the registration positioner 180 is located in the channel 190 of the registration positioner stop 178. The magnetic force ensures the proper position.

The fingers 160 are pulled away from the arms 158 against the biased of the spring 224 and rotated from the pin retracted position to the pin registration position. The dowels 228 projecting from the arms are located in the holes 230 in the fingers 160 to ensure alignment.

Referring to FIGS. 16 and 17, with the registration appendages 152 in proper position, the screen printing frame 28 is placed on the upper printing surface 18 of the pallet 14, with the pins 168 received by holes or slots 67 in the screen printing frame 28 by moving a flat bar from a substrate loading position to a printing position. With the screen printing frame 28 aligned, the frame holder 24 secures the screen printing frame 28. The movable bar 22 is raised upward lifting the screen printing frame 28 away from the pallet 14 and the pins 168. Other screen printing frames 28 are position in the printing machine 12 as described above with respect to the first embodiment. The process is repeated until all of the screen printing frame 28 are aligned and secured in the frame holder 24.

After all the screen printing frames 28 are aligned, the printer pulls the fingers 160 relative to the arms 158 against the biased of the spring 224. The fingers 160 are rotated from the pin registration position to the pin retracted position, such that the pins 168 project horizontally outward away from the pallet 14. The dowels 228 projecting from the arms are located in the holes 230 in the fingers 160 to ensure alignment.

The printer then grabs the arms 158 and rotates the registration appendages 152 about the thrust bearing 170 overcoming the magnetic force. The printer first rotates the arms 158 away from her or himself and away from the pallet arm 32 and then towards the pallet arm 32. The arms 158 are rotated until the retracted positioner 196 engages the retracted positioner stop 194. The magnetic force ensures proper position. The pins '68 project horizontally inward towards the pallet arm 32.

The printer is then able to slide the article such as a shirt 16 onto the pallet 14. With the pins 168 projecting inward and in addition the angle bracket 52 of the U-shaped bracket 40 creating surfaces that will minimize the likelihood that the shirt 16 will get caught upon installation.

Alternative Embodiment

Figure 24:
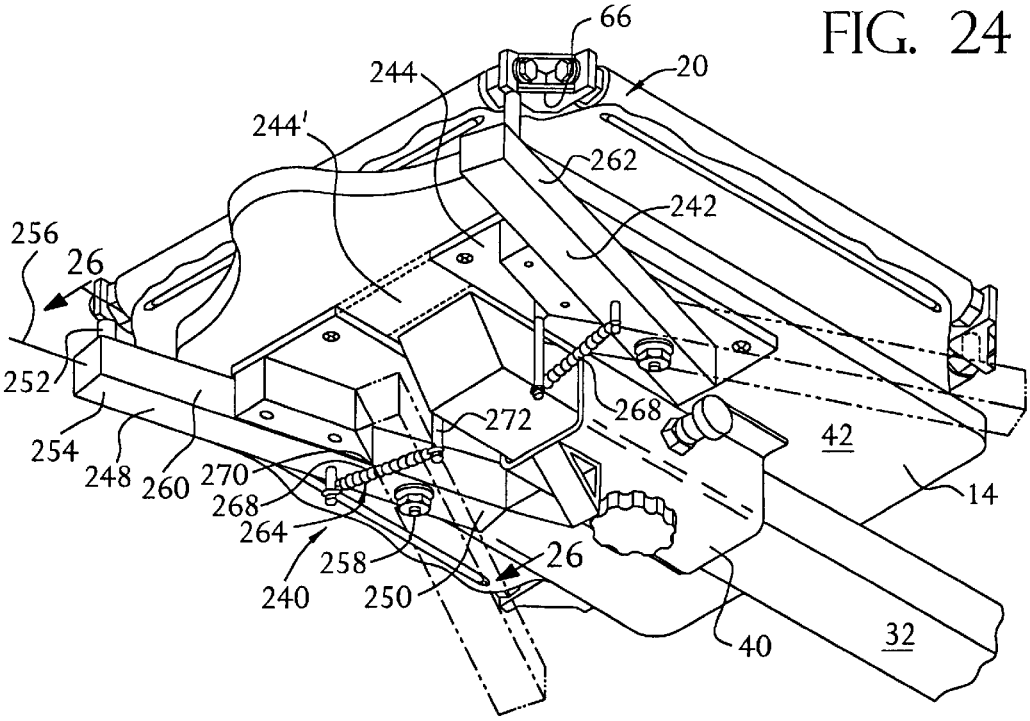
FIG. 24 is a bottom isometric view of the pallet with an alternate embodiment of the retractable registration apparatus with the registration appendages in a registration position. The registration appendages are shown in phantom in the retracted positions.

FIGS. 24–27 an alternative embodiment 240 of the retractable registration apparatus is shown. Referring to FIG. 24, the pallet 14 is mounted to the pallet arm 32 by the U-shaped bracket 40 similar to the previous embodiments.

Mounted on the lower mounting surface 42 of the pallet 14 is the retractable registration apparatus 240. The retractable registration apparatus 240 has a pair of registration appendages 242. Each registration appendage 242 is pivotably mounted to a plate 244. Each plate 244 is secured to the lower mounting surface 42 of the pallet 14. It is recognized that a single plate 244', as shown in hidden line, could be formed that receives both registration appendages 242 and does not interfere with the pallet arm 32.

Each registration appendage 242 has an arm 248 that is pivotable mounted at a first end 250 to the pallet 14. Unlike the previous embodiment, the registration appendage 242 does not have a finger that is rotatable relative to the arm 248. The registration appendage 242 has a pin 252 projecting from the arm 248 at the end opposite the pivot, a second end 254. The arm 248 defines a longitudinal axis 256 extending between the two ends 250 and 254.

The retractable registration apparatus 240 is shown in a registration position for aligning the screen printing frame 28 in the printing machine 12. The pin 252 on each arm 248 is received by a hole or slot in the corner member 66 to align the screen printing frame 28 so that it may be secured in the U-shaped channel 26 of the frame holder 24, not shown in this figure. The retractable registration apparatus 240 is shown in phantom in a retracted position allowing printing.

In that the registration appendages 242 are mirror images of each other, only one appendage 242 will be described in detail. In the retracted position, the pallet 14 can be used for printing without interference from the registration apparatus 240. Each of the arms 248 is pivotably mounted at the first end 250 to the plate 244 by a thrust bearing 258. The arm 248 has an inner side surface 260 and outer side surface 262; the names are related to when the arm 248 is in the registration position.

Figure 25:
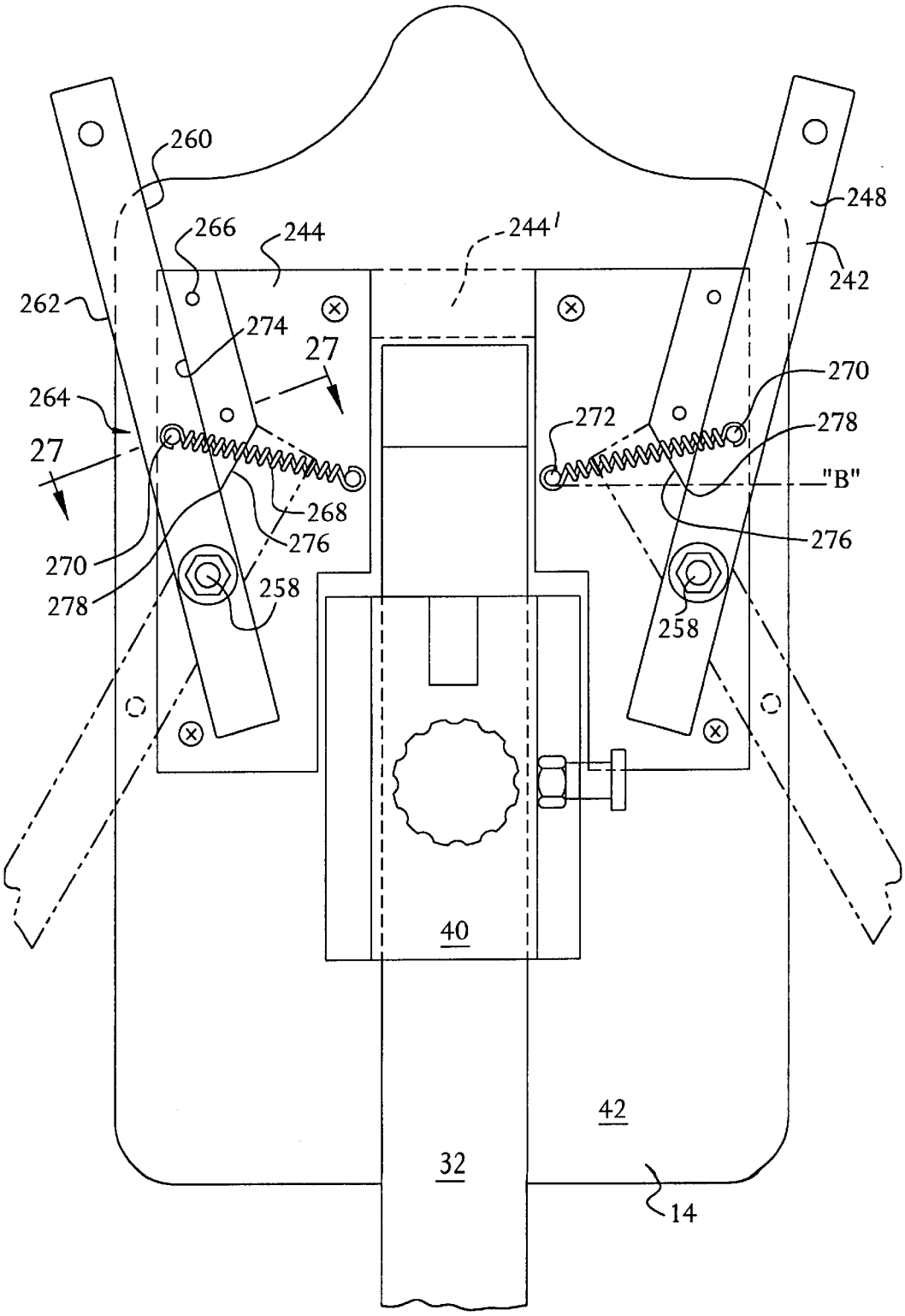
FIG. 25 is a bottom plan view of the pallet with the registrations appendages in the registered position. The registration appendages are shown in phantom in the retracted position.

The retractable registration apparatus 24 has a locking means, such as an over-center spring 264 to hold the arm 248 in the registration position. The over-center spring 264 has a registration position stop 266 mounted to the plate 144 and a tension spring 268. Referring to FIG. 25, the tension spring 268 extends from a pin 270 on the arm 248 to a post 272 depending from the plate 244. The post 272 is located inboard of the arm 248 and the registration position stop 266. The tension spring 268 of the over-center spring 264 holds the inner side surface 260 in engagement with a registration surface 274 of the registration position stop 266 to hold the arm 248 in the registration position.

The over-center spring 264 of the retractable registration apparatus 240 also acts as a second locking means to hold the arm 248 in the retracted position. The tension spring 268 of the over-center spring 264 holds the inner side surface 260 in engagement with a retracted surface 276 of the registration position stop 266 to hold the arm 248 in the retracted position. The surface of the inner side surface 260 which engages the retracted surface 276 is located on the other side of the thrust bearing 258 than the surface of the inner surface 260 which engages the registration surface 274. The registration surface 274 and the retracted surface 276 intersect at an intersection edge 278. The post 272 which receives one end of the tension spring 268 is located along a line "B" which extends perpendicular from the center line "A" of the pallet 14 and through the intersection edge 278 of the registration surface 274 and the retracted surface 276.

Figure 26:
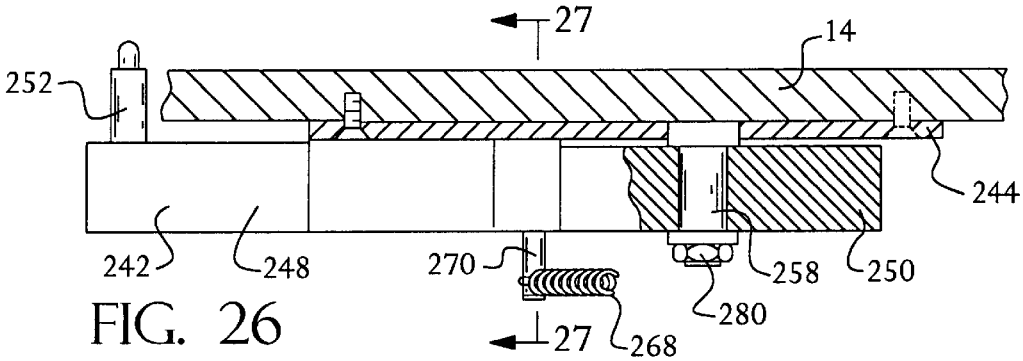
FIG. 26 is a sectional view of the pallet and registration appendages taken along the line 26—26 in FIG. 24.

Referring to FIG. 26, a sectional view taken along line 26—26 of FIG. 24, the thrust bearing 258 is mounted to the plate 244 which positions the arm 248 in spaced relation from the plate 244 such that the arm 248 is pivotable about the first end 250. The arm 248 engages the registration surface 274, not seen in this figure, of the registration position bar 266 to hold the registration appendage 242 in the registration position.

Figure 27:
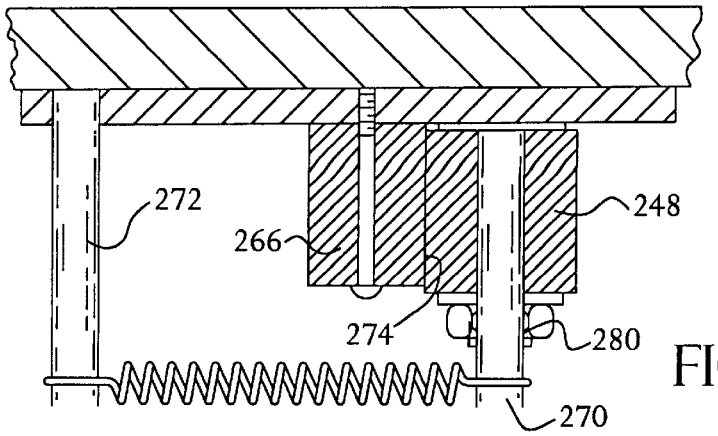
FIG. 27 is a sectional view of the pallet and registration appendages as taken along the line 27—27 in FIGS. 26 and 25.

Referring to FIG. 27, the arm 248 is shown spaced from the pallet 14 by the thrust bearing 258 to allow for movement of the arm 248. The thrust bearing 258 has a nut 280 to secure the arm 248. The over-center spring 264 has the registration position stop 266 mounted to the plate 244. The tension spring 268 extends between the pin 270 on the arm 248 and the post 272 depending from the plate 244.

FIGS. 28–35 show an alternative embodiment 290 of the retractable registration apparatus. Similar to the previous embodiments, the printing machine 12 has the pallet 14 for receiving an article 16 to print on, such as a shirt or poster. The portion of the article to be printed on, lies on top of the upper printing surface 18 of the pallet 14.

Figure 28:
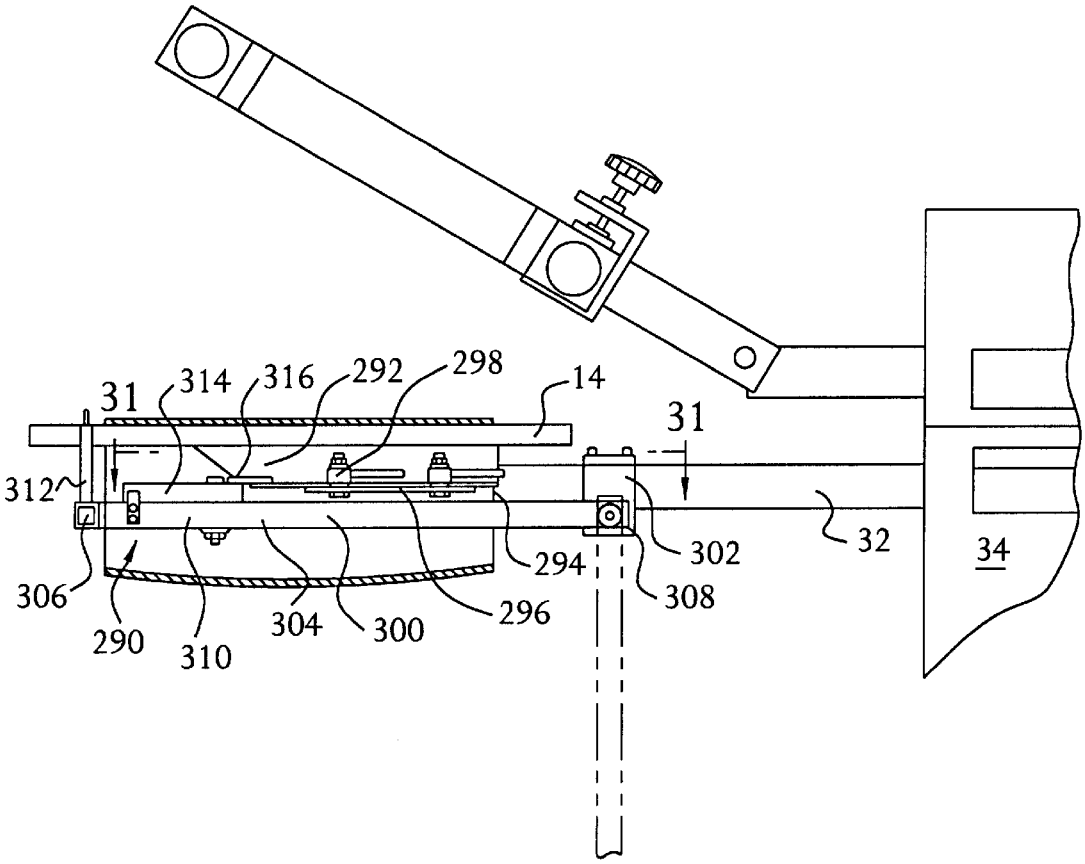
FIG. 28 is a side elevation and view of a screen printing machine having a pallet with an alternative embodiment of the retractable registration apparatus of the invention.

However, in contrast to the previous embodiments, the pallet 14 has an U-shaped bracket 292 which opens downward as seen in FIG. 28. The U-shaped bracket 292 has a pair of flanges 294 which project outward and are spaced from the lower mounting surface 42 of the pallet 14. The pallet arm 32 has a pair of flanges 296 located at the projected end. Each flange 294 of the U-shaped bracket 292 lies upon one of the flanges 296 of the pallet arm 32. The pallet arm 32 has a plurality of camming mechanisms 298 for securing the U-shaped bracket 292 of the pallet 14 to the flange 296 of the pallet arm 32 and thus the pallet 14 to the pallet arm 32.

Figure 31:
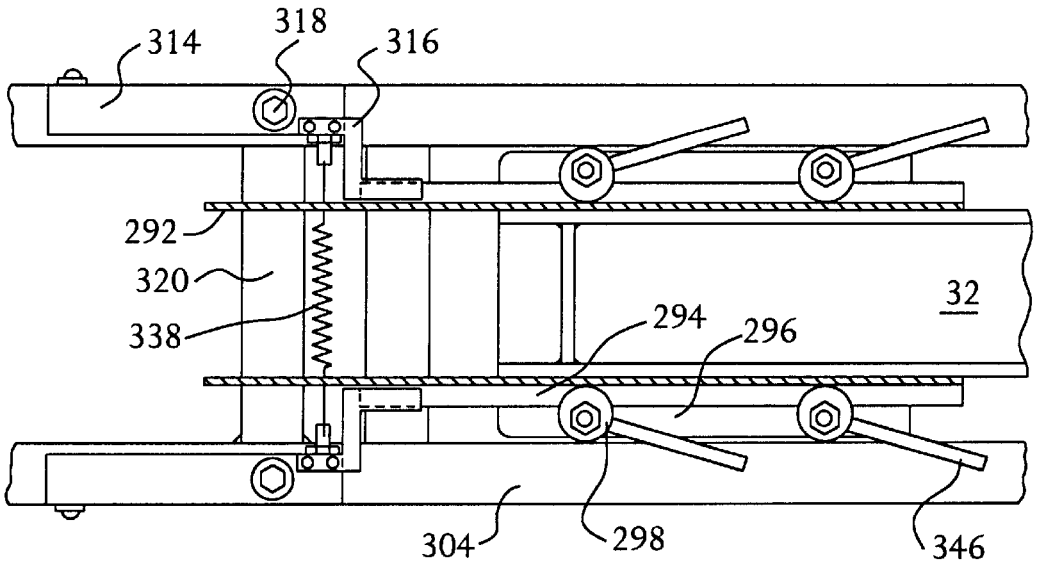
FIG. 31 shows the interface between the pallet arm and the pallet.

The retractable registration apparatus 290 has a registration appendage 300. The registration appendage 300 has a mounting bracket 302, an arm 304 and a transverse bar 306. The mounting bracket 302 is mounted to the pallet arm 32 between the pallet 14 and the central hub 34. The arm 304 is pivotably mounted at a first end 308 to the mounting bracket 302 for movement between a registration position and a retracted position, shown in phantom. The transverse bar 306 is mounted to the arm 304 at a second end 310. The transverse bar 306 has a plurality of pins 312. As best seen in FIG. 31, the registration appendage 300 has a pair of latching levers 314, only one seen, pivotably mounted to the arm 304. Each latching lever 314 has a detent 316, such as a plate, for engaging the flange 294 of the U-shaped bracket 292 of the pallet 14 for retaining the retractable registration apparatus 290 in the registration position.

Figure 29:
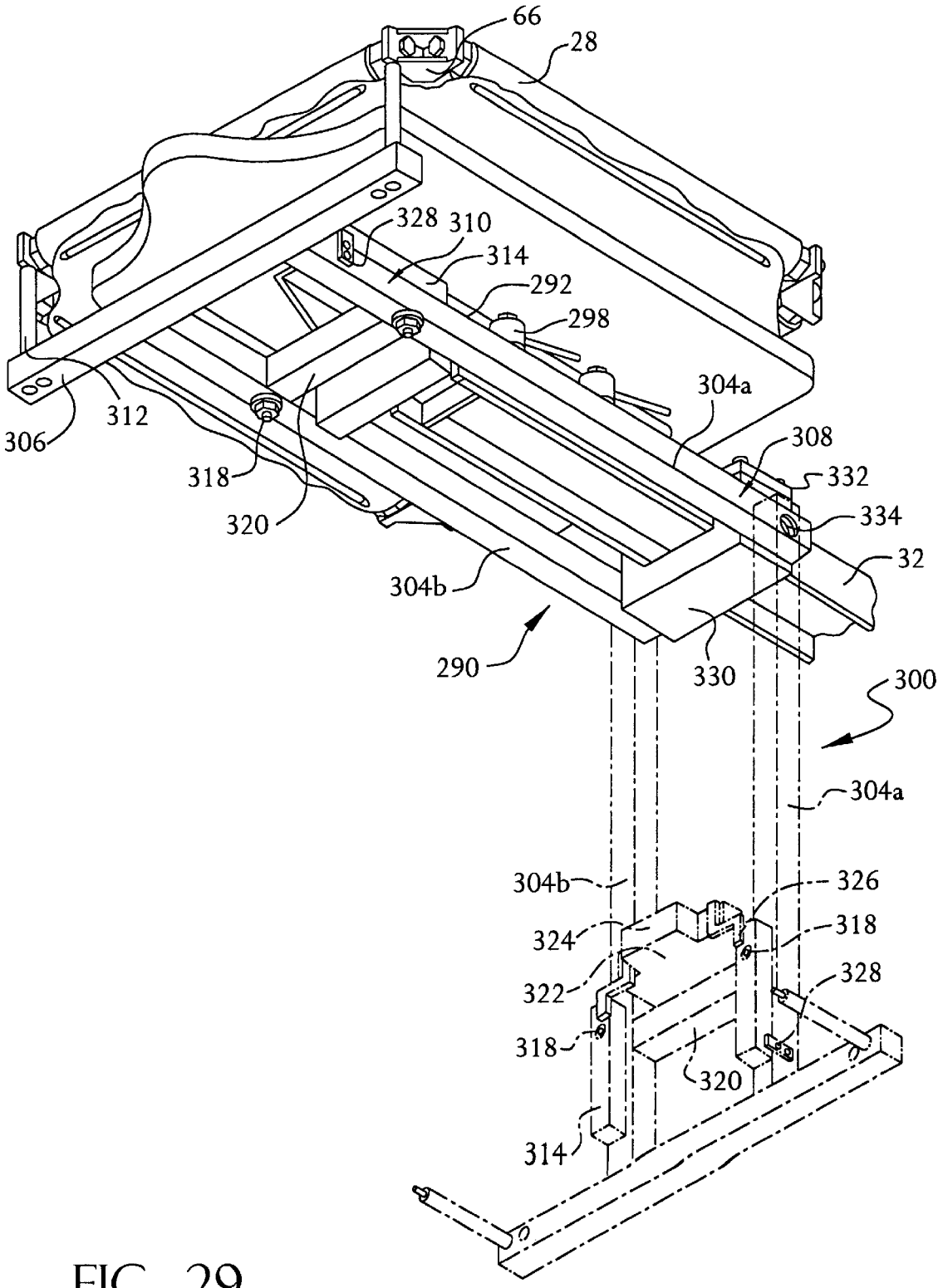
FIG. 29 is a bottom isometric view of the pallet having the registration appendages in a registration position. The registration appendages shown in a phantom in the retracted position.

Referring to FIG. 29, the retractable registration apparatus 290 is shown in the registration position for aligning the screen printing frame 28 in the printing machine 12. The retractable registration apparatus 290 is shown in phantom in the retracted position. The outer pins 312 on the transverse bar 306, in this particular embodiment, are received by a hole or slot 67 in the corner member 66 to align the screen printing frame 28 so that it may be secured in the U-shaped channel 26 of the frame holder 24. (The frame holder 24 is not shown in FIG. 29).

The arm 304 of the registration appendage 300 has a pair of parallel bars 304*a* and 304*b*. The bars 304*a* and 304*b* extend from the mounting bracket 302 to the transverse bar 306. The latching levers 314 are each pivotably mounted at the pivot point 318 to a respective bar 304*a* or 304*b*. The arm 304 has a stiffening bar 320 which extends between the two bars 304*a* and 304*b* in proximity to the pivot points 318.

The retractable registration apparatus 290 has a stop block 322 also located between the two bars 304*a* and 304*b*, as best seen in the phantom retracted position. The stop block 322 has a raised center portion 324 adapted to be received by the U-shaped bracket 292 of the pallet 14. The stop block 322, in addition, has a pair of lower side portions 326 adapted to engage the flanges 294 of the U-shaped bracket 292 of the pallet 14. The plates 316 which are mounted to the latching levers 314 are "Z" shaped and are located above the lower side portions 326 of the stop block 322 when in an engaging position. The retractable registration apparatus 290 has a pair of stops 328 mounted to the outboard side of the two bars 304*a* and 304*b* for limiting the movement of the latching levers 314.

Figure 32:
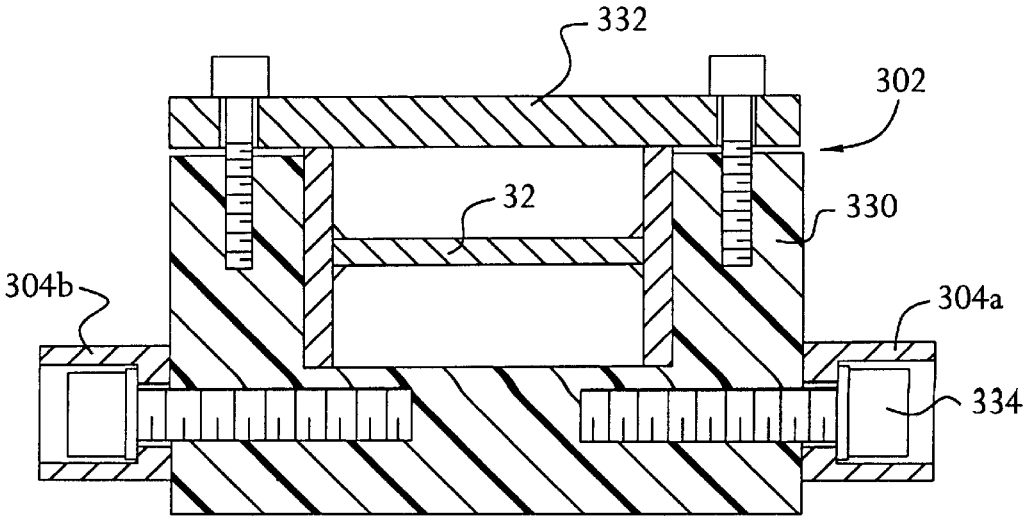
FIG. 32 is a sectional view of the pivot point of the registration appendage taken along the line 32—32 in FIG. 30.

Referring to FIGS. 29 and 32, the mounting bracket 302 has an U-shaped bracket 330 and a plate 332. The pallet arm 32 passes through the U-shaped bracket 330 and is retained by the plate 332. The bars 304*a* and 304*b* of the arm 304 are located on either side of the U-shaped bracket 330. The arm is pivotable mounted to the mounting bracket 302 by a pair of fasteners 334 for movement between the registration position and the retracted position.

Figure 30:
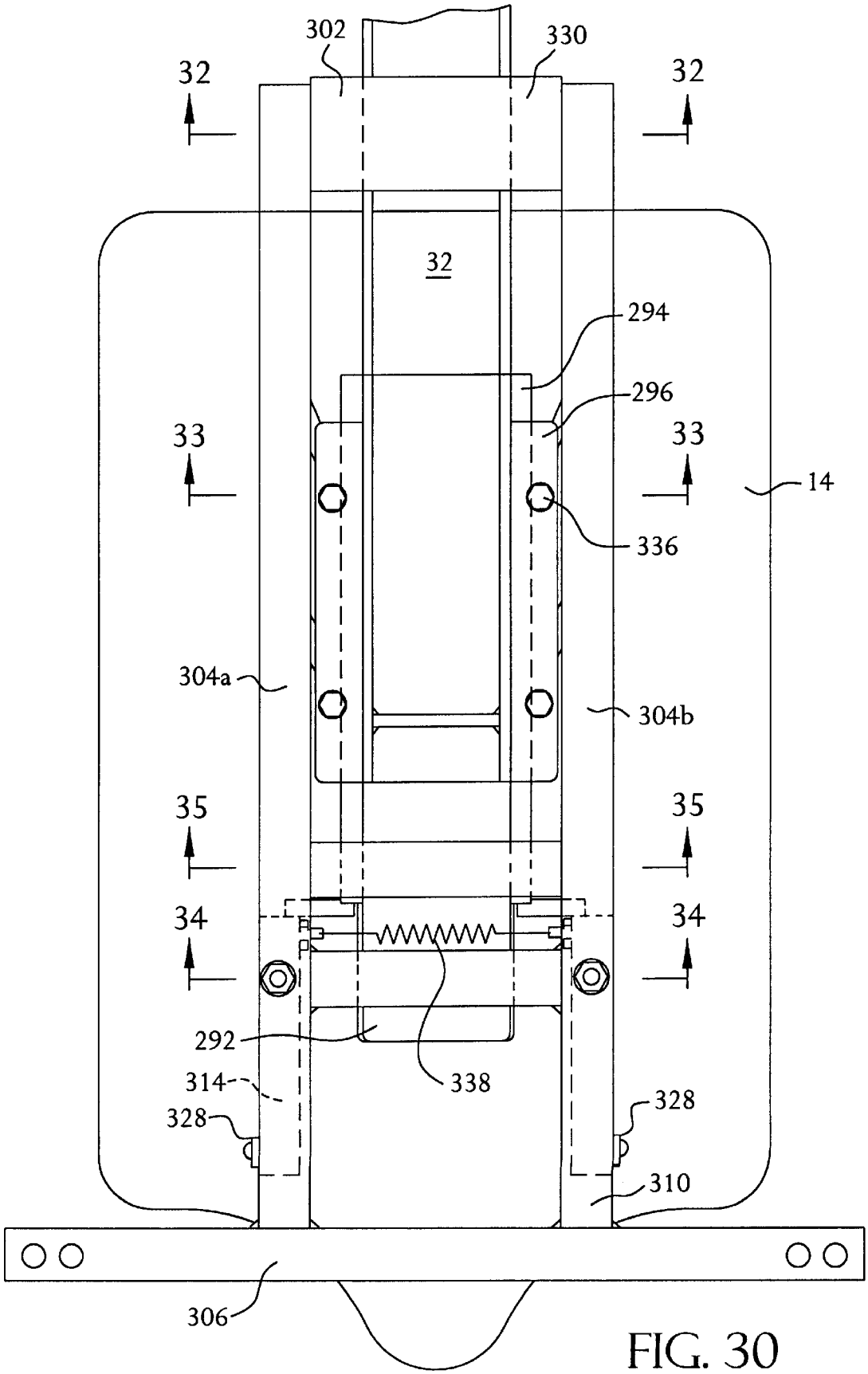
FIG. 30 is a bottom plan view of the pallet with the registration appendages shown in the registered position.

Referring to FIG. 30, the bars 304*a* and 304*b* are parallel with the pallet arm 32 and equally spaced from the pallet arm 32. The flanges 294 of the U-shaped bracket 292 lie upon, under in this view, the flanges 296 of the pallet arm 32. The camming mechanism 298, only the pivot portion 336 shown in this view, secure the U-shaped bracket 292 of the pallet 14 to the flange 296 of the pallet arm 32.

The retractable registration apparatus 290 has a tension spring 338 extending between the two latching levers 314 to bias the latching levers 314 to the engaging position. The detent plates 316, which are mounted to the latching levers 314, are located above, below in this figure, the flanges 294 of the U-shaped bracket 292 of the pallet 14. The stops 328 for limiting the movement of the latching levers 314, shown in hidden line, are both seen in this Figure.

Figure 33:
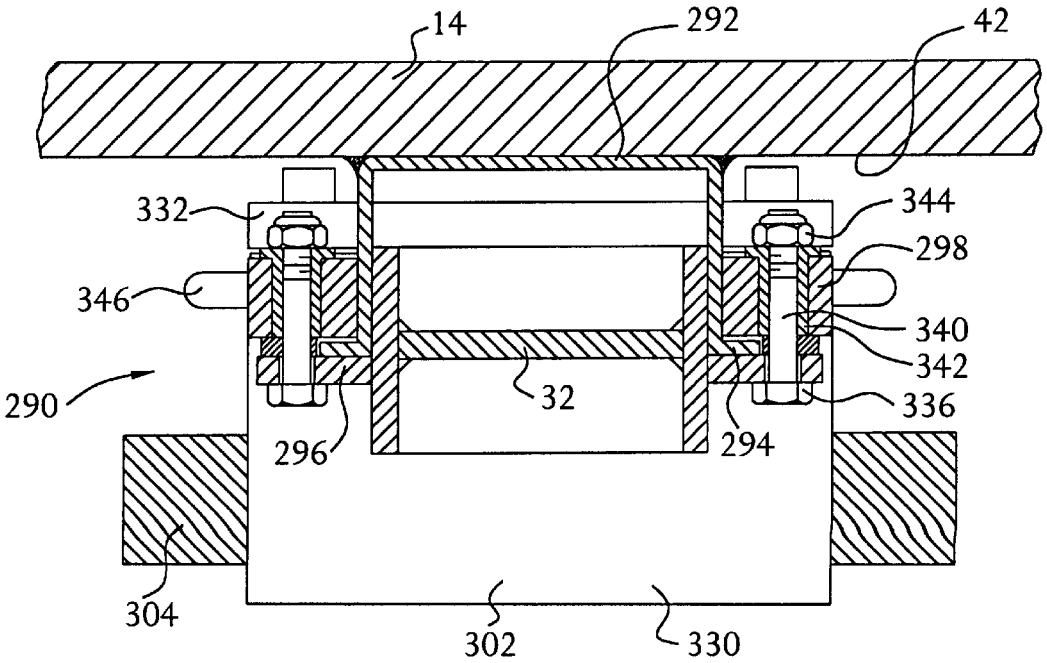
FIG. 33 is a sectional view of the pallet arm/pallet interface taken along the line 33—33 in FIG. 30.

Referring to FIGS. 31 and 33, the interface between the pallet arm 32 and the pallet 14 is shown. The pallet 14 has the U-shaped bracket 292 opening downward. The pair of flanges 294 of the U-shaped bracket 292 project outward and are spaced from the lower mounting surface 42 of the pallet 14. The pair of flanges 296 of the pallet arm 32 are located at the projected end of the pallet arm 32. Each flange 294 of the U-shaped bracket 292 lies upon one of the flanges 296 of the pallet arm 32. The plurality of camming mechanism 298, only two seen in FIG. 33, of the pallet arm 32 secure the U-shaped bracket 292 of the pallet 14 to the flange 296 of the pallet arm 32 and thus the pallet 14 to the pallet arm 32. The pivot portion 336 of the camming mechanism 298 is a bolt 340 which extends through a cylindrical cam 342 at an off-center location of the camming mechanism 298 and a nut 344. The cam 342 has a handle 346 to assist in rotation of the camming mechanism 298.

Figure 34:
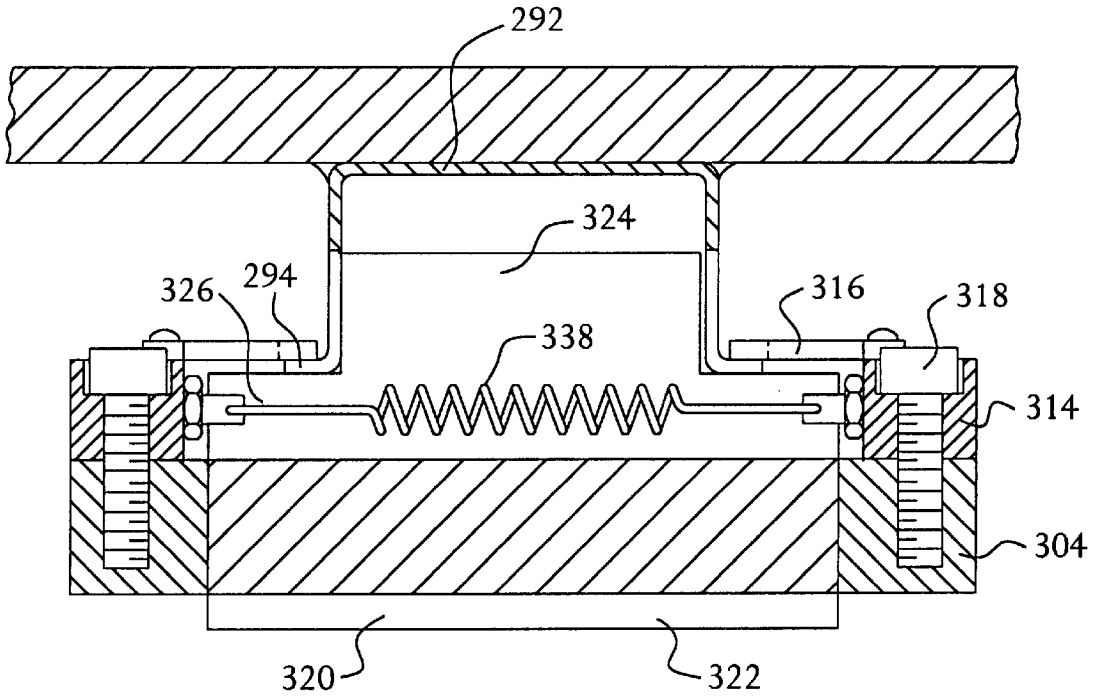
FIG. 34 is a sectional view of the locking mechanism of the registration appendage taken along the line 34—34 in FIG. 30.

Referring to FIGS. 31 and 34, the plate 316 which projects from the latching lever 314 is shown overlying the flange 292 of the U-shaped bracket 292 of the pallet 14. Each of the latching levers 314 is pivotably mounted at the pivot point 318 to the bar 304*a* or 304*b* respectively. The spring 338 extends between the two latching levers 314 and biases the levers 314 toward the engaging position. The stiffening bar 320 extends between the bars 304*a* and 304*b* of the arm 304. The stop block 322 is positioned in the U-shaped bracket 292 of the pallet 14 when the registration apparatus is in the registration position of FIG. 29.

Figure 35:
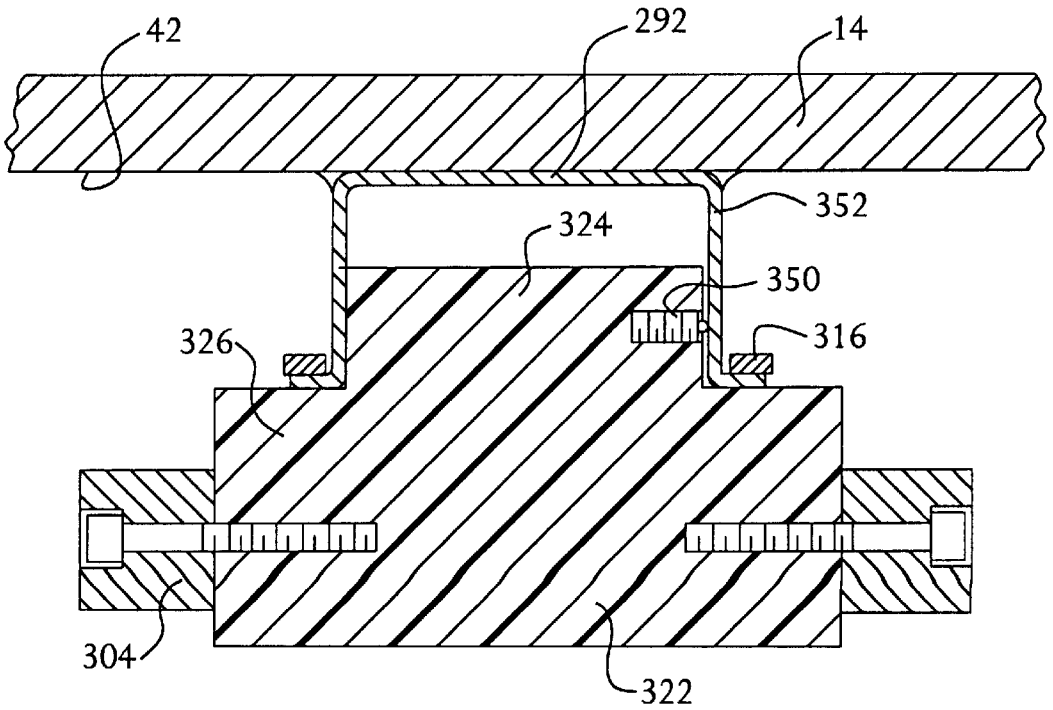
FIG. 35 is a sectional view of the stop block engaging the u-shaped bracket taken along the line 35—35 in FIG. 30.

Referring to FIGS. 31 and 35, the side portions 326 of the stop block 322 engage the lower portion of the flange 294 of the U-shaped bracket 292. The retractable registration apparatus 290 has a biasing means 350, such as a pin urged by a spring, to hold the raised center portion 324 against one of the side walls 352 of the U-shaped bracket 292. The stop block 322 is secured between the two bars 304*a* and 304*b* of the arm 304.

In operation, the printer raises the retractable registration apparatus 290 from the retracted position, as shown in phantom in FIG. 29, toward the registration position. While the retractable registration apparatus 290 is not shown with a mechanism to assist the operator in raising the apparatus 290, it is recognized that an air cylinder, spring or other mechanism could be used to assist in both the raising from and lower to the retracted position.

Referring to FIGS. 30 and 34, the printer rotates the latching levers 314 inward, therein moving the plates 316 outward. With the detent plates 316 rotated outward, the stop block 322 can be moved into the U-shaped bracket 292 with the biasing means 350 engaging one of the side walls 352. The side portions 326 engage the flange 294 of the U-shaped bracket 292 to limit upper movement of the retractable registration apparatus 290. With the apparatus 290 in the registration position, the printer releases the latching levers 314 and the spring 338 rotates the levers 314 such that the plates 316 are located above the flanges 294 of the U-shaped bracket 292. The pins 312 are now in position to be accepted by the screen printing frame 28 to align the frame.

Figure 36:
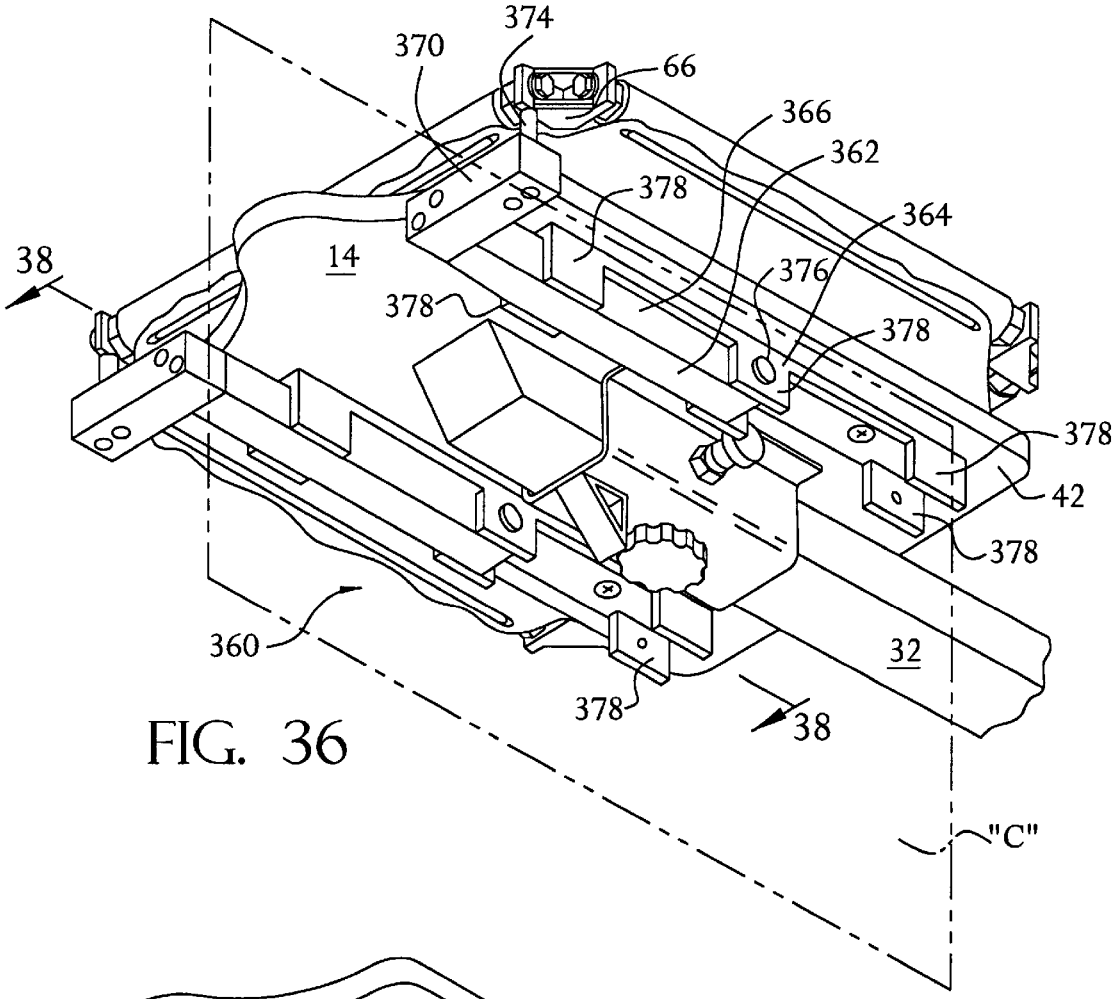
FIG. 36 is a bottom isometric view of the pallet with an alternate embodiment of the retractable registration apparatus in a registration position.
Figure 37:
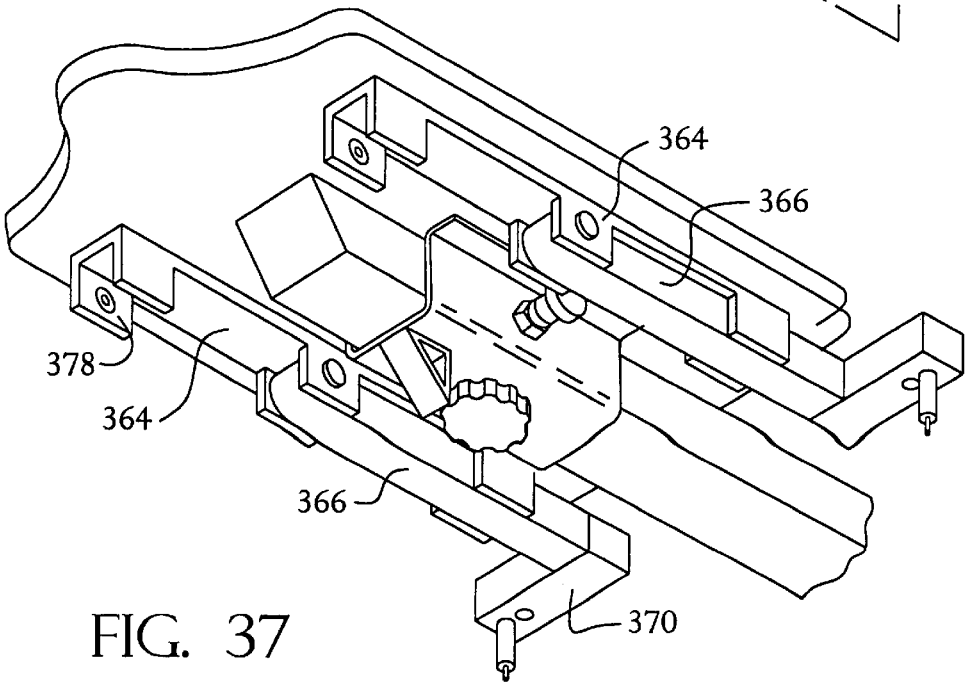
FIG. 37 is a bottom isometric view of the alternate embodiment of the retractable registration apparatus of FIG. 36 in a retracted position.

FIGS. 36–39 show an alternative embodiment 360 of the retractable registration apparatus. As of filing, this is the preferred embodiment for manual printing machines. Referring to FIG. 36, the pallet 14 is mounted to the pallet arm 32 similar to the previous embodiments with the exception of the previous embodiment. The method of mounting the pallet 14 to the pallet arm 32 is not relevant to the invention.

Mounted on the lower mounting surface 42 of the pallet 14 is the retractable registration apparatus 360. The retractable registration apparatus 360 has a pair of registration appendages 362. Each registration appendage 362 is pivotably mounted to an appendage housing 364 for vertical rotation. Each appendage housing 364, similar to the plates of several of the earlier embodiments, is secured to the lower mounting surface 42 of the pallet 14. Each registration appendage 364 has an arm 366. The arm 366 is pivotably mounted at a first end 368 to the pallet 14 and has a "L" shaped projection 370, a finger, at a second end 372. The "L" shaped projection 370 has a plurality of pins 374.

The retractable registration apparatus 360 is shown in a registration position in FIG. 36 for aligning the screen printing frame 28 in the printing machine 12. The screen printing frame 28 has corner members 66 having a hole or slot 67. The outer pins 374 on each "L" shaped projection 370 of the arm 366, in this particular embodiment, are received by a hole or slot in the corner member 66 to align the screen printing frame 28 so that it may be secured in the U-shaped channel of the frame holder.

Figure 39:
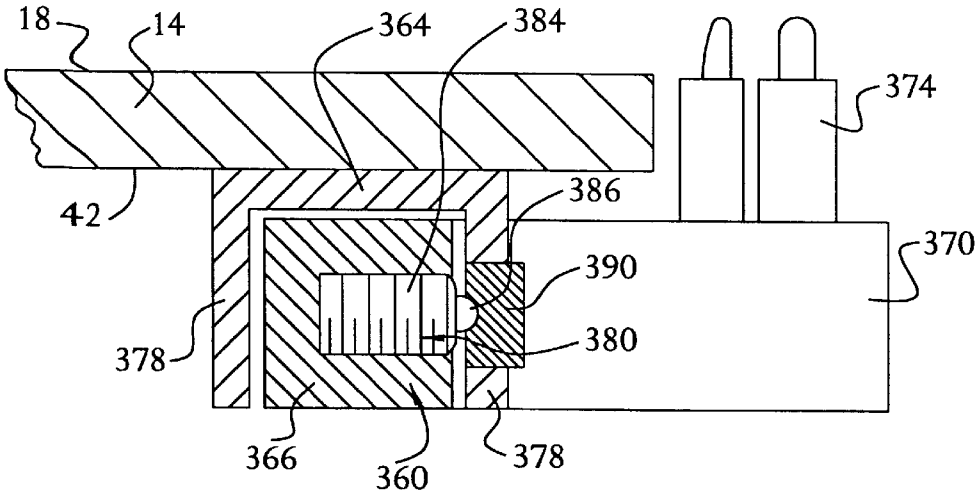
FIG. 39 is a sectional view of the arm/appendage housing interface along the line 39—39 of FIG. 38.
Figure 40:
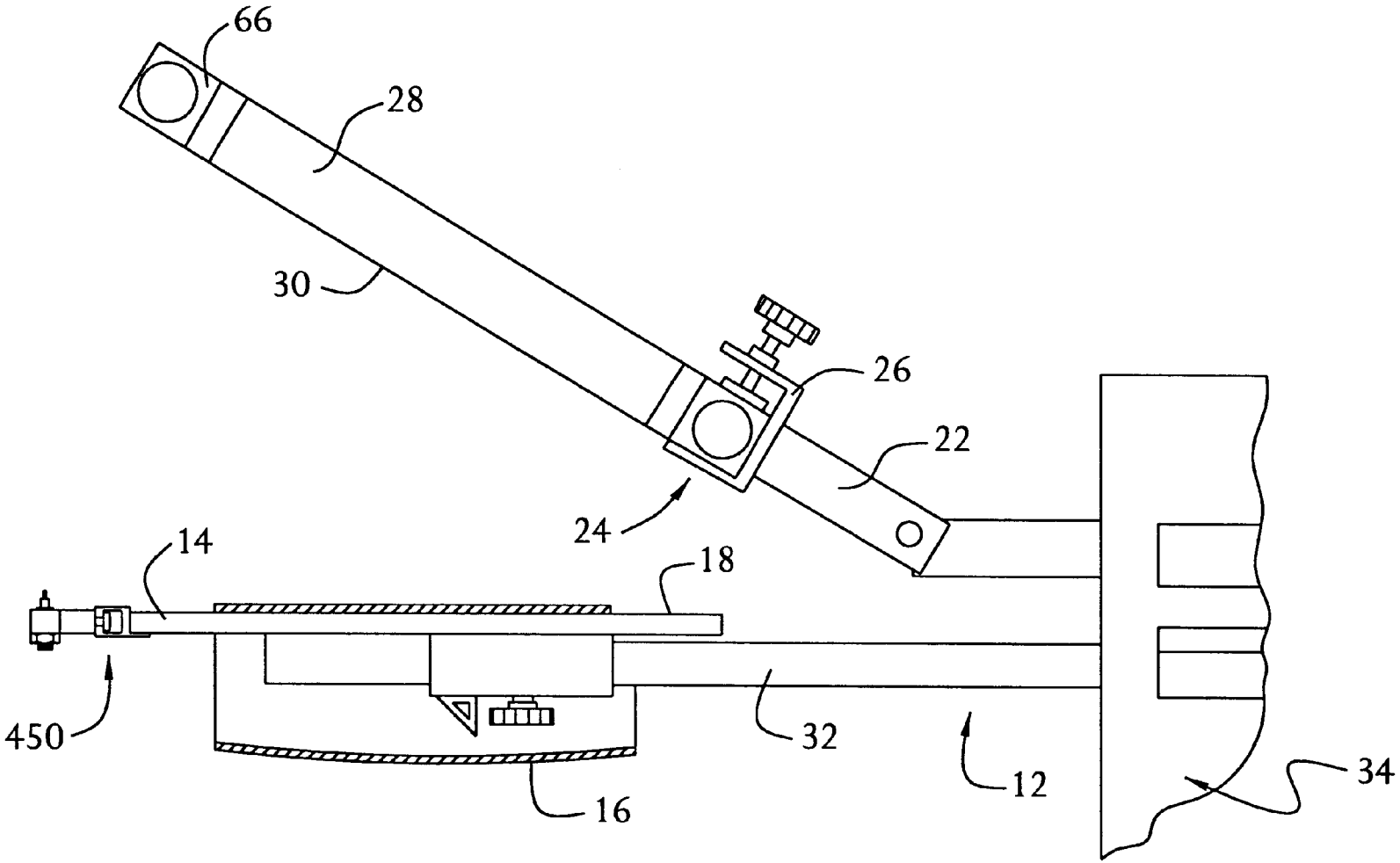
FIG. 40 is a side elevation view of a screen printing machine having an image platform, such as a pallet, with an additional alternative embodiment of the retractable registration apparatus of the present invention and a screen printing frame attached to a screen holder.

In that the registration appendages 362 are mirror images of each other about the center line "C" of the pallet 14, only one appendage 362 will be described in detail. In the retracted position, the pallet 14 can be used for printing without interference from the retractable registration apparatus 360. Each of the arms 366 is pivotably mounted at the first end 368 to the appendage housing 364 by a bearing 376 for vertical rotation. The appendage housing 364 has a pair of depending walls 378 for carrying the bearing 376. As best seen in FIG. 39, the retractable registration apparatus 360 has a locking means, such as a detent mechanism 380, to hold the arm 366 in the registration position.

Figure 38:
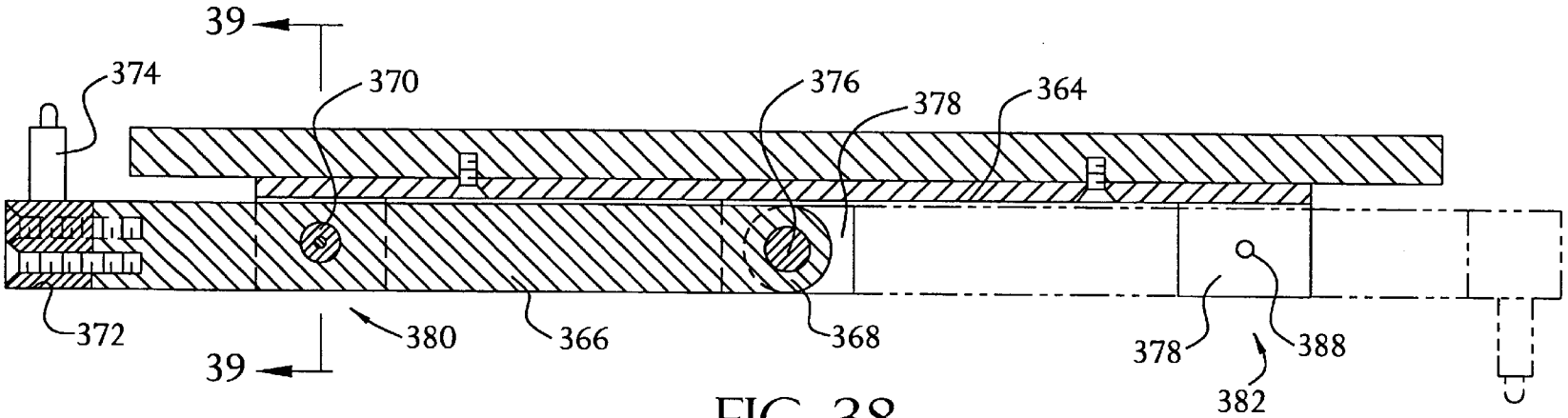
FIG. 38 is a sectional view of the registration appendage taken along the line 38—38 in FIG. 36.

Referring to FIG. 38, the retractable registration apparatus 360 is shown in a retracted position allowing printing. The retractable registration apparatus 360 has a locking means, such as a detent mechanism 382, to hold the arm 366 in the retracted position.

Referring to FIGS. 38 and 39, the detent mechanisms 380 and 382 share a detent 384, such as a ball plunger, located on the arm 366. The detent 384 is received by a detent hole 386 and 388, respectively, formed in the side wall 378 of the appendage housing 364. The detent hole 386 is located in a hardened bushing 390 to reduce wear and ensure properly position of the pins 374 when the arm 366 is in the registration position. The detent hole 388 used for the retracted position could also be located in a hardened bushing, but is not in the preferred embodiment shown.

The retractable registration apparatus 360 is shown in phantom in the retracted position in FIG. 38.

It is recognized that the "L" shaped portion 370, which carries the pins 374, could be pivotably mounted the arm 366 as in previous embodiments, such as shown in FIGS. 6, 12, 13, 17, and 18.

FIGS. 40–44 show another alternate embodiment 450 of the retractable registration apparatus. Similar to the embodiment shown in FIG. 1, the printing machine 12 has a pallet 14 for receiving an article 16 to print on, such as a shirt or poster. The portion of the article 16 to be printed on, lies on top of the upper printing surface 18 of the pallet 14. The U-shaped channel 26 of the frame holder 24, at the end of the movable bar 22, receives the screen printing frame 28. The screen printing frame 28 includes a screen mesh 30 which contains an image to be transferred to the article 16.

The pallet 14 is linked to the frame holder 24 by a pallet arm 32 which extends from a central portion 34 of the printing machine 12. The printing machine 12 has a mechanism (not shown) for separating the frame holder 24 from the pallet 14. In the present embodiment, pivotal movement of the movable bar 22, relative to the stationary pallet arm 34, raises the frame holder 24 and screen printing frame 28, away from the pallet 14. In addition, the central portion 34 of the printing machine 12 allows rotation of the pallet 14 and the pallet arm 32 relative to the frame holder 24 to move another pallet 14, not shown, underneath the screen printing roller frame 28. In this way, the pallet 14 is moved to another screen printing station.

Figure 41:
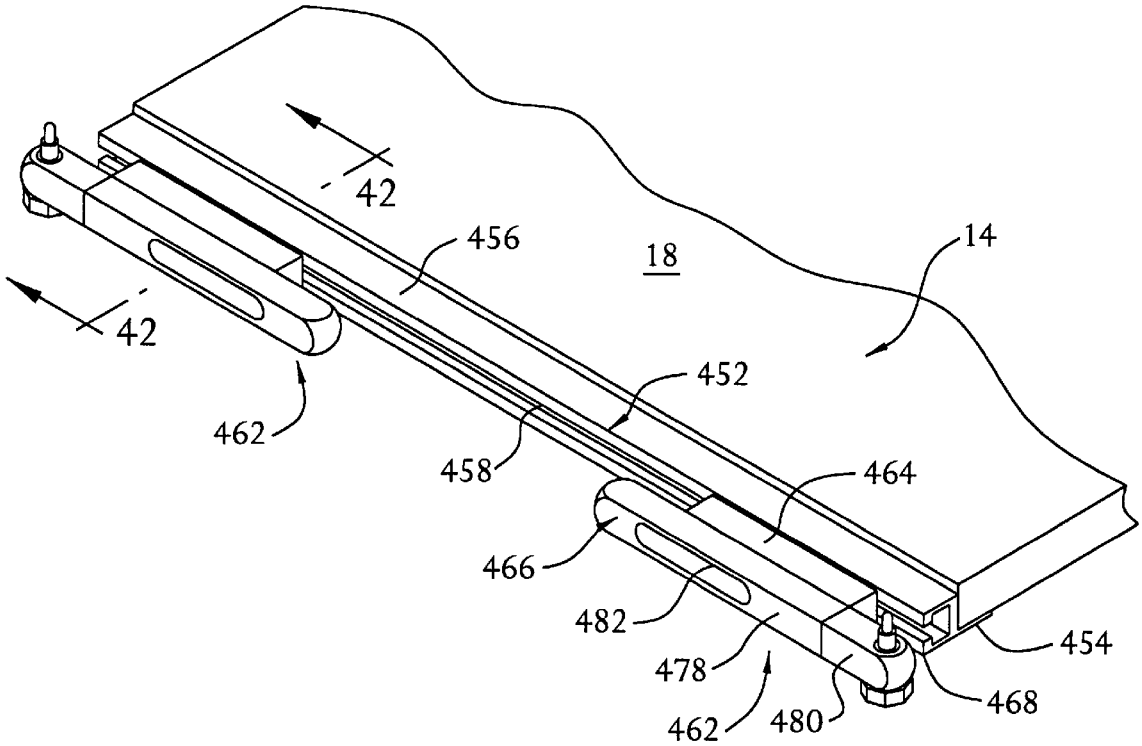
FIG. 41 is a partial isometric view of the embodiment shown in FIG. 40.
Figure 42:
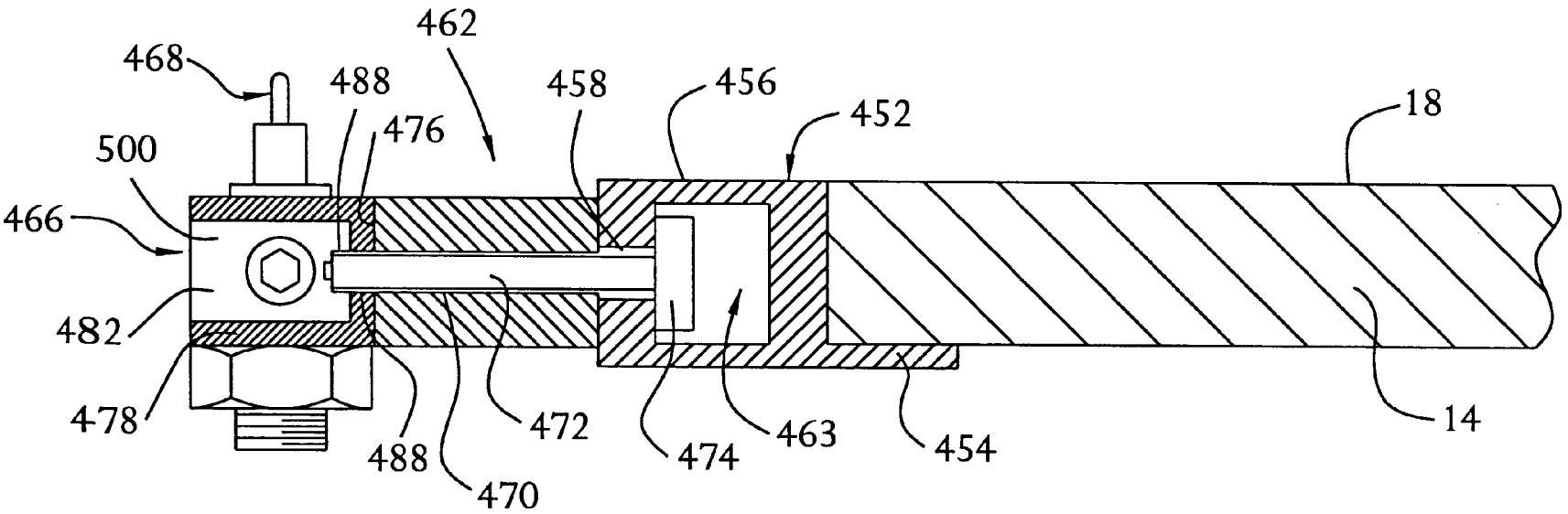
FIG. 42 is a cross-sectional view taken along the line 42—42 in FIG. 41.

Referring to FIGS. 41 and 42, the registration apparatus 450 comprises a rectangular channel 452. The rectangular channel 452 includes an extending flange 454 which attaches to the underside of the pallet 14 by any suitable means, such as double-sided adhesive tape, mechanical fasteners, or the like. It is contemplated that the rectangular channel 452 is sized such that its top wall 456 does not extend past the plane formed by the upper face 18 of the pallet 14. This prevents interference with the printing frame 28 when the printing frame 28 is adjacent to the pallet 14 during a printing operation.

A slot 458 is formed in a wall 460 of the rectangular channel 452 to communicate with the interior cavity 463 of the rectangular channel. It is contemplated that the slot 458 extends the entire length of the channel 452, as best seen in FIG. 41.

A pair of registration appendages 462 are coupled to the rectangular channel 452. Each registration appendage 462 includes a spacer 464 and an elongated registration arm 466 extending therefrom.

The spacer 464 spaces the registration arm 466 from the rectangular channel 452. The spacer 464 is sized such that the registration appendage 462 can be readily adapted to any sized screen printing frame 28 such that the registration elements 468 of the arm 466 engage with the corresponding registration element (not shown) on the end of the screen printing frame 28.

Referring to FIG. 42, a pair of bores 470 (only one shown) extend through the body of the spacer 464 for receiving the shaft 472 of a bolt 474 positioned in the interior chamber 463 of the rectangular channel 452. The shaft 472 of the bolt 474 is sized to extend through the body of the spacer 464 and protrude past its opposite end 476.

Referring to FIGS. 41 and 42, the registration arms 462 include an elongated arm 478 and a finger 480 notably attached to the end of the arm 478. A groove 482 is formed in the body of the registration arm 478 to provide a cavity therein. As best seen in FIG. 42, a pair of enlarged openings 484 (only one shown) are provided in end wall 486 of the arm body 466 for receiving the end of the bolt shaft 472. The end of the bolt shaft 472 is threaded to accept a nut 488 to secure the elongated arm 478 on the spacer 464.

This arrangement allows the pair of registration appendages 462 to be slidably coupled to the rectangular channel 452 to accommodate printing screens of various widths. Of course, any suitable connector could be employed which allows the registration appendages to be slidably positioned on the rectangular channel 452.

As shown in FIG. 41, the fingers 480 are shown in the registration position. The screen printing frame 28 has corner members 66 having a hole or slot 67, as best seen in FIG. 5 with respect to the first embodiment. The registration elements 468, such as the pins shown on each finger 480 in this particular embodiment, are received by a complementary hole or slot in the corner member 66 to align the screen printing frame 28 so that it may be secured in the U-shaped channel 26 of the frame holder 24.

Figure 43:
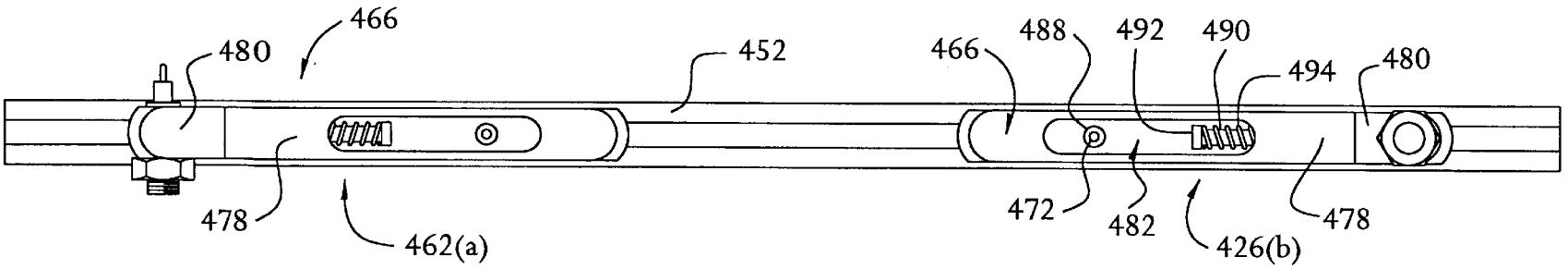
FIG. 43 is a front elevational view of the embodiment shown in FIG. 40.

Referring to FIG. 43, the finger 480 may be rotated from a registration position to a retracted storage position. The finger 480 of the registration appendage 462*a* is shown in the pin registration position, whereas the finger 480 of the right side registration appendage 462*b* is shown in the retracted position.

Figure 44:
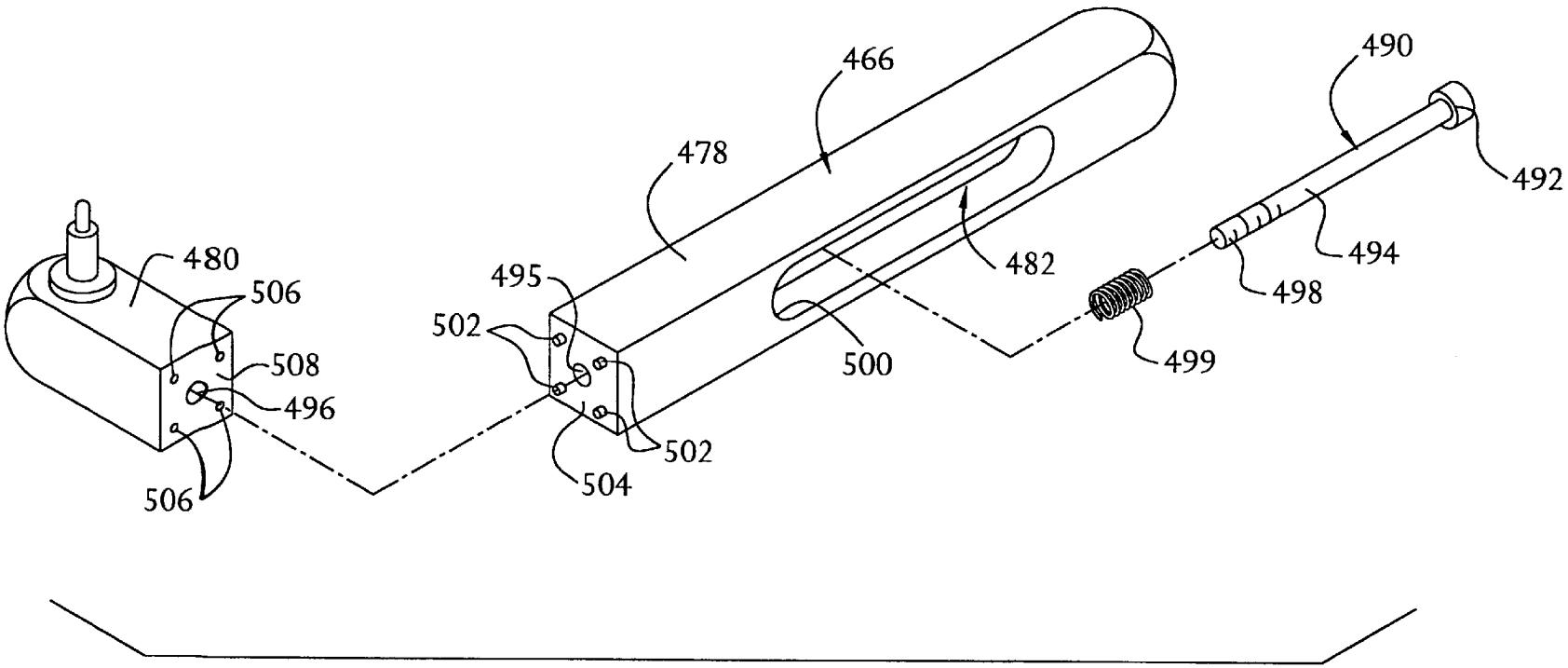
FIG. 44 is an exploded isometric view of the registration apparatus of the embodiment shown in FIG. 40.

Referring to FIGS. 43 and 44, the finger 480 is secured to the arm 478 by a bolt 490. The bolt 490 has a head 492 which is received in the cavity 482 in the arm body 478. The shaft 494 of the bolt 490 extends through a longitudinal bore 495 in the arm 466. The shaft 494 extends past the end wall 504 of the arm 466 and is received by a longitudinal threaded bore 496 in the finger 480. The end 498 of the bolt 490 is threaded to engage the threaded bore 496 to secure the finger 480 to the arm 478.

A spring 499 is disposed on the shaft 494 of the bolt 490 between the head 492 and an end wall 500 of the cavity 482 in the arm body 478. The spring 499 biases the finger 480 into engagement with the arm body 478. A plurality of spaced dowels 502 extend from an end wall 504 of the arm body 478. The dowels 502 are received by a plurality of bores 506 formed in the end wall 508 of the finger 480. The dowels 502 and the bores 506 align the finger 480 in the pin registration position and the pin retracted position. The operation of the rotatable finger 480 is similar to that described in connection with the rotatable finger 160 described in FIG. 22.

The registration element 468 is depicted in the Figures as a pin. However, it should be understood that the registration element 46 could also be formed as a hole or slot to engage complementary pins formed on the corner members of the screen printing frame.

Figure 45:
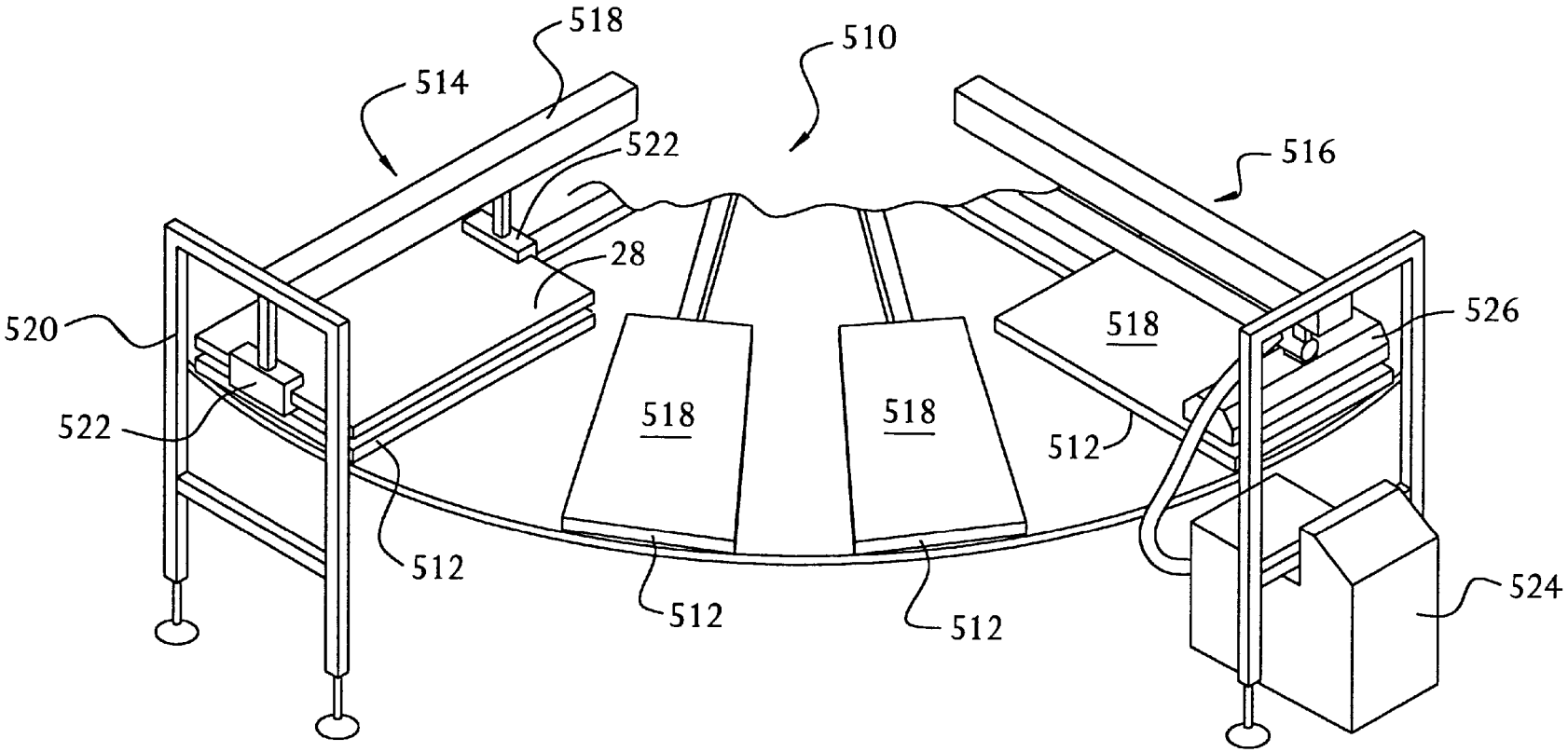
FIG. 45 is a partial isometric view of a screen printing machine having a plurality of rotatable image platforms with an alternative embodiment of the retractable registration apparatus of the present invention.
Figure 46:
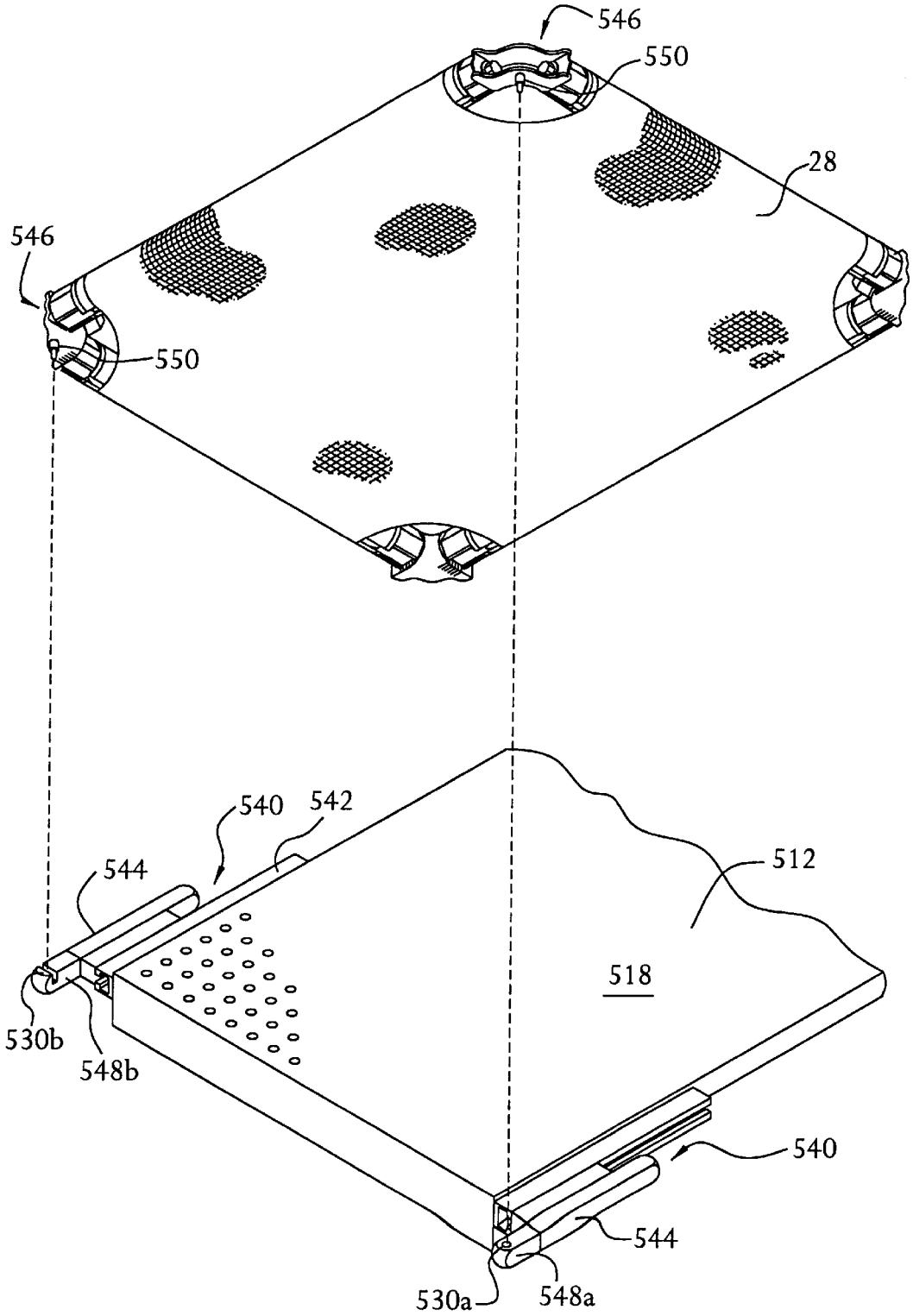
FIG. 46 is an exploded isometric view of the embodiment shown in FIG. 45.
Figure 47:
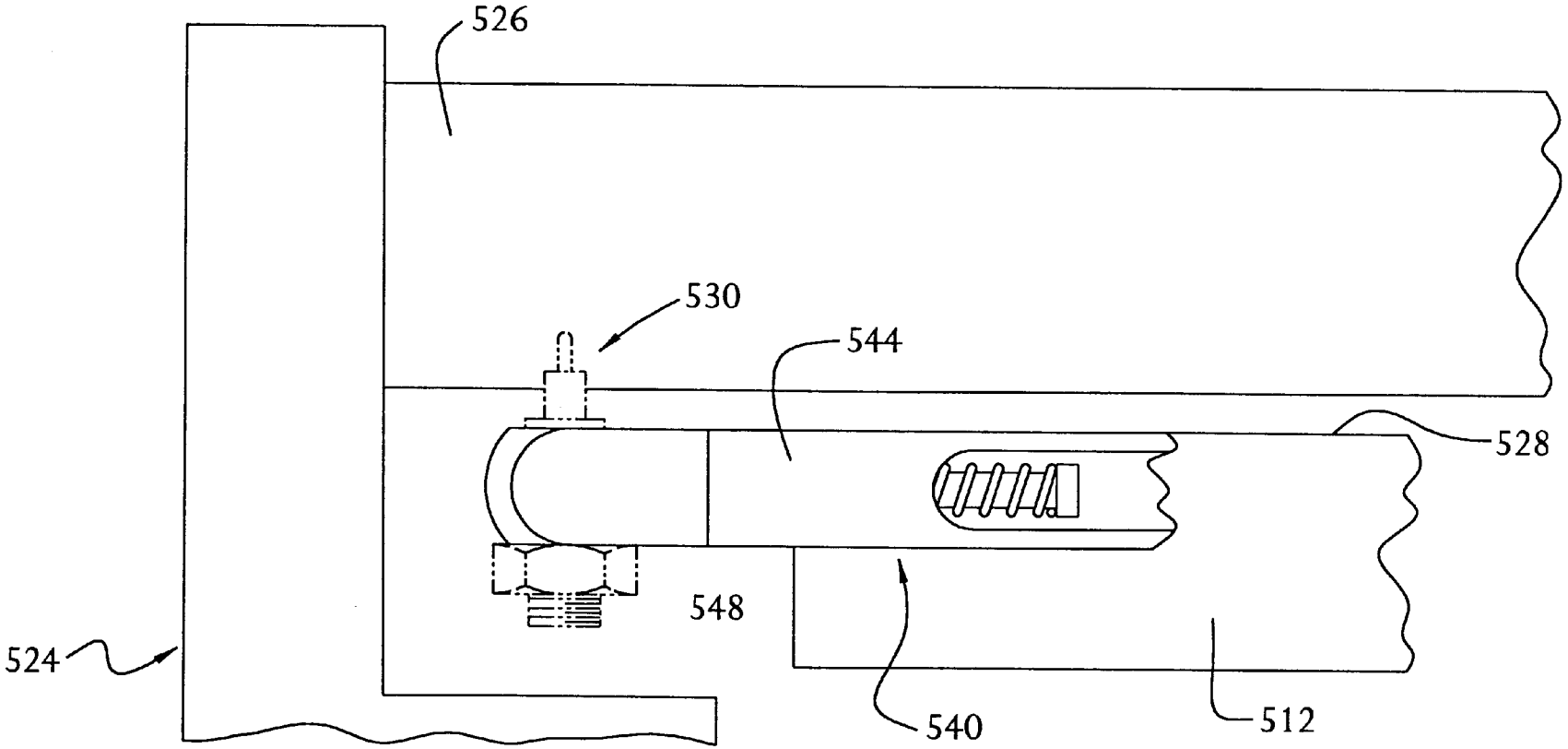
FIG. 47 is a schematic side elevational view of a pallet having the registration apparatus of the embodiment shown in FIG. 45 in the drying station.

In FIGS. 45–47, there is shown another alternative embodiment of the present invention.

In FIG. 45, there is shown a printing machine 510 having a plurality of image platforms or vacuum pallets 512 which extend like spokes from a central hub (now shown). The vacuum pallets 512 support a substrate on the top surface 518 thereof. The central hub includes a mechanism for rotating the pallets 512 around the central hub to different stations, such as a printing station 514 and a drying station 516.

The printing station 514 includes a beam 518 which extends from the central hub to an end support 520. A pair of C-shaped frame holders 522 extend downwardly from the beam 518. The frame holders 522 hold a screen printing frame 28 therebetween. The pallets 512 rotate into position below the screen 28 for a printing operation to be performed on the substrate (not shown) held by the pallet.

Subsequently, the pallet 512 is rotated to a drying station 516 to dry the ink applied to a substrate. The drying station 516 includes a UV dryer 524 and a UV drying head 526 which is positioned in close proximity to the upper face 518 of a pallet 512 in the drying station.

In this type of printing machine, the drying head 526 is stationary and must be in close proximity to the upper face 518 of the pallet 512 to adequately dry the wet substrate thereon.

In FIG. 47, the drying head 526 is schematically shown as it would be positioned in an operational position above the pallet 512 in the drying station 516.

It should be clear that there is limited clearance between the top face 518 of the pallet 512 and the lowermost surface of the drying head 526. As such, the possibility exists that a registration pin 530 (shown in phantom) extending from a registration appendage 540 attached to the pallet 512 could interfere with the closely-spaced drying head 526 when the pallet is rotated into the drying station 526. For this reason, it is necessary that the registration element of the registration appendage 540 be a hole and slot arrangement as shown in FIG. 46.

Referring now to FIG. 46, pallet 512 includes a pair of registration appendages 540 mounted to either side of the pallet. The registration appendages 540 are similar to the registration appendages 462 describing the connection with FIGS. 40–44. The only differences between the registration appendages 540 and the registration appendage 462 is the arrangement of the mounting channels 452 and the particular embodiment of the registration elements.

The registration appendages 540 are mounted to the sides of the pallet 512. Thus, each registration apparatus 540 includes its own separate mounting channel 542 for mounting to the sides of the pallet 512. In this arrangement, the registration arms 544 extend past the end of the pallet 512 to be properly positioned to engage the registration elements 546 from the corner brackets of the printing frame. The top surface of the registration appendages 540 are mounted flush with the top surface 518 of the pallet 512 so that they do not interfere with the drying head 526, but are still capable of interfacing with the registration elements 546 on the printing frame 28. Each arm 544 include rotatable finger 548*a* or 548*b*, which extend from the end of the arms 544. Finger 548*a* includes a registration element 530*a* and finger 540*b* includes registration element 530*b* for interfacing with the cooperative registration elements 546 on the printing frame 28. In this embodiment, the registration element 530*a* is a bore and the registration element 530*b* is a slot which engages the pins 550 of the registration elements 546 of the screen printing frame 28.

Since the registration elements 530*a* and 530*b* are an opening and a slot, respectively, the registration elements 530*a* and 530*b* do not contain any structure which extends past the plane formed by the top face 518 of the pallet 512. In this way, the registration elements 530*a* and 530*b* will not interfere with the closely-spaced drying head 526 of the UV dryer 524 when the pallet 512 is rotated into position in the drying station 516.

The present invention may be embodied in other specific forms without departing from the spirit or essential attributes thereof and, accordingly, reference should be made to the appended claims, rather than to the foregoing specification, as indicating the scope of the invention. It is recognized that while a specific locking mechanism or retaining mechanism is shown is each of the embodiments, other mechanisms such as ball plungers, spring plungers, latches, spring clip or magnetic could be used. The locking mechanism (means) and retaining mechanisms (means) can be similar mechanisms; the terms are used to distinguish the registration position from the retracted position.

We claim:

1. A retractable registration apparatus adapted to be mounted on a printing machine for aligning a printing screen frame with a holder, the apparatus comprising:

a mount for securing the registration apparatus to a printing machine, an appendage pivotably attached to the mount;

a registration element located on the appendage for coupling with a cooperating element formed on a printing screen frame;

a pivot coupling the appendage and the mount for allowing the appendage to rotate from a registration position to a retracted position; and a detent for releasably fixing the appendage in the registration position.

2. A retractable registration apparatus according to claim 1, wherein a second detent retains the appendage in the retracted position.

3. A retractable registration apparatus according to claim 2, further comprising a stop carried by the image platform, the stop having a registration surface for engaging the arms to position the arms in the registration position.

4. A retractable registration apparatus according to claim 3, wherein the stop comprises a second surface, for engaging the arm to position the arm in the retracted position.

5. A retractable registration apparatus according to claim 4, further comprising a biasing means for retaining the arm in the exact registration position and the retracted position.

6. A retractable registration apparatus according to claim 5, wherein the biasing means comprises an over-center spring.

7. A retractable registration apparatus according to claim 1, wherein the appendage comprises a pair of appendages, each having an arm and a finger rotatably mounted to the arm.

8. A retractable registration apparatus according to claim 1, further comprising a second appendage, and a second registration element located on the second appendage.

9. A retractable registration apparatus according to claim 1, wherein the appendage comprises an arm and a transverse bar, and wherein the transverse bar is secured to the arm and carries the registration element.

10. A retractable registration apparatus according to claim 9, wherein the printing machine has a pallet arm for carrying an image platform, the registration element comprises a pair of registration pins for engaging the printing screen frame, and the arm is pivotably mounted to the pallet arm for rotation between the registration position and the retracted position.

11. A retractable registration apparatus according to claim 10, wherein the arm comprises a pair of parallel bars, one end of each bar is mounted to the pallet arm, the transverse bar is secured to the other end of each bar.

12. A retractable registration apparatus according to claim 11, wherein the detent comprises a stop located between the bars for positioning the arm and at least one detent element for engaging a bracket carried by the image platform.

13. A retractable registration apparatus according to claim 1, further comprising: a pallet arm for carrying an image platform, wherein the appendage comprises a pair of appendages, each appendage comprising an arm pivotably mounted to the image platform.

14. A retractable registration apparatus according to claim 13, wherein the registration element comprises a pair of registration pins for engaging the printing screen frame.

15. A retractable registration apparatus according to claim 14, further comprising a second detent for retaining the arm in the retracted position.

16. A retractable registration apparatus according to claim 15, wherein the arms are pivotably mounted for substantially horizontal rotation.

17. A retractable registration apparatus according to claim 16, wherein the first and second detents comprise magnets.

18. A retractable registration apparatus according to claim 17, wherein each appendage further comprises a finger rotatably mounted to the arm.

19. A retractable registration apparatus according to claim 16, wherein the second detent comprises a magnet carried by the image platform, the arm having a protrusion, and the magnet having a complementary groove for receiving the protrusion.

20. A retractable registration apparatus according to claim 15, wherein the arms are pivotably mounted for vertical rotation.

21. A registration apparatus adapted to be mounted on an imaging forming platform for aligning a printing screen frame with a holder, the apparatus comprising:

a mount for securing the registration apparatus to an imaging forming platform, at least one arm attached to the mount;

a registration element located on an end of the at least one arm for coupling with a cooperating element formed on a printing screen frame, the end of the at least one arm being pivotably attached to the remainder of the arm for allowing the end to rotate from a registration position to a retracted position; and a detent for releasably fixing the end in the registration position.

22. A retractable registration apparatus according to claim 21, wherein the at least one arm comprises a pair of arms attached to the mount, the registration element comprising a pair of elements, each attached to one of the ends of the arms.

23. A registration apparatus according to claim 22, wherein, the registration elements are pins.

24. A registration apparatus according to claim 22, wherein the mount comprises a pair of channels attached to the image forming platform, and each of the arms is attached to one of the channels by a spacer.

25. A registration apparatus according to claim 22, wherein, the registration elements are a slot and a hole and do not extend substantially above the plane of the image forming platform.

* * * * *